US006315364B1

(12) United States Patent
Fujita et al.

(10) Patent No.: US 6,315,364 B1
(45) Date of Patent: Nov. 13, 2001

(54) CUSHION AND SEAT EACH HAVING NET-LIKE SKIN

(75) Inventors: Etsunori Fujita; Hiroki Ohshimo; Shigeki Wagata; Masaki Nishino; Yumi Ogura; Kazuyoshi Chizuka; Shigeyuki Kojima, all of Hiroshima; Taizo Nakata, Osaka; Hidehiro Oda, Houfu; Eiichi Koyama, Osaka; Yoshiaki Nagae; Kazuhiro Ueda, both of Matsubara, all of (JP)

(73) Assignees: Delta Tooling Co., Ltd., Hiroshima; Kanebo Limited, Tokyo; Kanebo Gosen, Ltd.; Suminoe Textile Co., Ltd., both of Osaka, all of (JP)

( * ) Notice: Subject to any disclaimer, the term of this patent is extended or adjusted under 35 U.S.C. 154(b) by 0 days.

(21) Appl. No.: 09/529,804

(22) PCT Filed: Oct. 21, 1998

(86) PCT No.: PCT/JP98/04760

§ 371 Date: May 18, 2000

§ 102(e) Date: May 18, 2000

(87) PCT Pub. No.: WO99/20159

PCT Pub. Date: Apr. 29, 1999

(30) Foreign Application Priority Data

Oct. 21, 1997 (JP) ..... 9-288796

(51) Int. Cl.[7] ..... A47C 7/02

(52) U.S. Cl. ..... 297/452.56

(58) Field of Search ..... 297/452.56, 452.55, 297/452.1, 452.63, 452.64, 452.42, 463.2

(56) References Cited

U.S. PATENT DOCUMENTS

| | | | |
|---|---|---|---|
| 5,013,089 | | 5/1991 | Abu-Isa et al. . |
| 5,378,040 | * | 1/1995 | Chaney et al. . |
| 5,393,126 | * | 2/1995 | Boulva . |
| 5,533,789 | * | 7/1996 | McLarty, III et al. . |

FOREIGN PATENT DOCUMENTS

| | | |
|---|---|---|
| 58-144467 | 9/1983 | (JP) . |
| 60-31864 | 3/1985 | (JP) . |
| 64-39052 | 3/1989 | (JP) . |
| 1-158761 | 11/1989 | (JP) . |
| 6-77699 | 11/1994 | (JP) . |
| 3017352 | 8/1995 | (JP) . |
| 9-70339 | 3/1997 | (JP) . |

* cited by examiner

*Primary Examiner*—Milton Nelson, Jr.
(74) *Attorney, Agent, or Firm*—Wenderoth, Lind & Ponack, L.L.P.

(57) ABSTRACT

A seat or bed partly includes frames 8, 14 and net-shaped skins 10, 16 held by the frames 8, 14 under tension, respectively. Each of the net-shaped skins 10, 16 is made of an upper mesh layer 24, a lower mesh layer 26, and a pile layer having a large number of piles 28 that connect the upper and lower mesh layers 24, 26 to each other. Each pile 28 is made of a single string.

19 Claims, 42 Drawing Sheets

(a)

(b)

(c)

(a)

(b)

(c)

(d)

(a)

(b)

(a)

(b)

CUSHION AND SEAT EACH HAVING NET-LIKE SKIN

TECHNICAL FIELDS

The present invention relates to a cushioning member having a net-shaped skin that has excellent air permeability and can be employed in a seat, bed or the like, and also relates to a seat employing such a cushioning member.

BACKGROUND ART

Conventional automotive seats generally include spring members such as coil springs, S-shaped springs, or formed wire springs mounted on a seat frame, a pad material such as a foamed material, rocking material, or cotton placed thereon, and a skin such as a vinyl leather, woven cloth, or leather covered thereon.

In order to enhance the elasticity or shock-absorbing properties, those in which a viscoelastic material is embedded in the pad material have been proposed.

Furthermore, when a user keeps sitting on a seat for many hours, those portions of the user that are held in contact with a seat cushion and a seat back become moist with sweat and, hence, an unpleasant feeling increases. To overcome this problem, seats having enhanced air permeability by forcibly feeding air from the inside of the seat cushion and the seat back have also been proposed.

On the other hand, seats or beds other than the automotive seats generally include a pad material placed on the frame and covered with a skin, and some of them also include spring members for enhancing the cushioning characteristics.

Although the spring members or the pad material acts to provide desired cushioning characteristics, some of the conventional seats or beds referred to above cannot eliminate a bottom-end shock, and such seats or beds are mostly heavy and costly.

In motorcycles having a viscoelastic material embedded in the pad material, if gasoline that has leaked out during refueling or water such as rainwater is splashed thereon and is brought into contact with the viscoelastic material, it sometimes changes the nature thereof. In the automotive seats, there is a possibility of fogging in which volatile components contained in the viscoelastic material fog window panes.

Although the seats in which air is forcibly fed from the inside of the seat cushion and the seat back have excellent air permeability, they are costly because they require a device for forcibly feeding air or an air passage formed in the pad material.

The present invention has been developed to overcome the above-described disadvantages. It is accordingly an objective of the present invention to provide a relatively light all-weather cushioning member or seat having a net-shaped skin that has excellent air permeability and heat dissipating characteristics while maintaining desired cushioning characteristics and eliminating a bottom-end shock.

DISCLOSURE OF THE INVENTION

In accomplishing the above objectives, a cushioning member having a net-shaped skin according to the present invention comprises a frame and a net-shaped skin tensioned over the frame, said net-shaped skin comprising an upper mesh layer, a lower mesh layer, and a pile layer having a large number of piles that connect the upper and lower mesh layers, each of the piles being made of a single string.

It is preferred that each of the frame and the net-shaped skin is made of a thermoplastic resin, and both of them are joined together by vibration welding.

Alternatively, the frame is made of a metal, while the net-shaped skin is Made of a thermoplastic resin, wherein after the net-shaped skin has been joined to at least one holding member made of a thermoplastic resin, the holding member is secured to the frame.

Again alternatively, after the net-shaped skin has been secured at a periphery thereof to a holding member by a string, the holding member is secured to the frame.

It is also possible to form a resinous frame at a periphery of the net-shaped skin by insert molding and to secure the resinous frame to the frame.

A seat having a net-shaped skin according to the present invention is characterized in that at least one of a seat cushion, a seat back, and a head rest includes a frame and a net-shaped skin tensioned over the frame, wherein the net-shaped skin includes an upper mesh layer, a lower mesh layer, and a pile layer having a large number of piles that connect the upper and lower mesh layers, each of the piles being made of a single string.

Furthermore, a cushioning member having a net-shaped skin according to the present invention is characterized in that the net-shaped skin is of a three-layered structure including an upper mesh layer, a lower mesh layer, and a pile layer having a large number of piles that connect the upper and lower mesh layers, each of the piles being made of a single string, the pile layer presenting a cross texture as viewed in a predetermined direction.

This cushioning member has non-linear static load-deflection characteristics and also has at least three spring constants in a normal use region, a region smaller in load than the normal use region, and a region greater in load than the normal use region, wherein the spring constant in the normal use region is set to the smallest one.

Preferably, rigid members or elastic members are disposed at predetermined intervals in at least one direction, thereby increasing a surface rigidity or elasticity of the upper mesh layer.

Also, engageable members may be mounted on a periphery of the net-shaped skin by sewing and vibration welding, wherein the engageable members are mounted on a portion of a seat.

Alternatively, the engageable members are mounted on a periphery of the lower mesh layer, wherein the engageable members are mounted on a portion of a seat under the condition in which the pile layer is not compressed.

The engageable members may be mounted on the periphery of the lower mesh layer by extrusion molding.

A seat according to the present invention is also characterized by a plurality of net-shaped skins laminated one upon another, wherein each of the net-shaped skins is of a three-layered structure including an upper mesh layer, a lower mesh layer, and a pile layer having a large number of piles that connect the upper and lower mesh layers, each of the piles being made of a single string, the pile layer presenting a cross texture as viewed in a predetermined direction.

A plurality of rolled net-shaped skins may be arranged in a side-by-side fashion in place of the plurality of laminated net-shaped skins.

DETAILED DESCRIPTION OF THE PREFERRED EMBODIMENTS

Embodiments of the present invention are discussed hereinafter with reference to the drawings.

Figure 1:
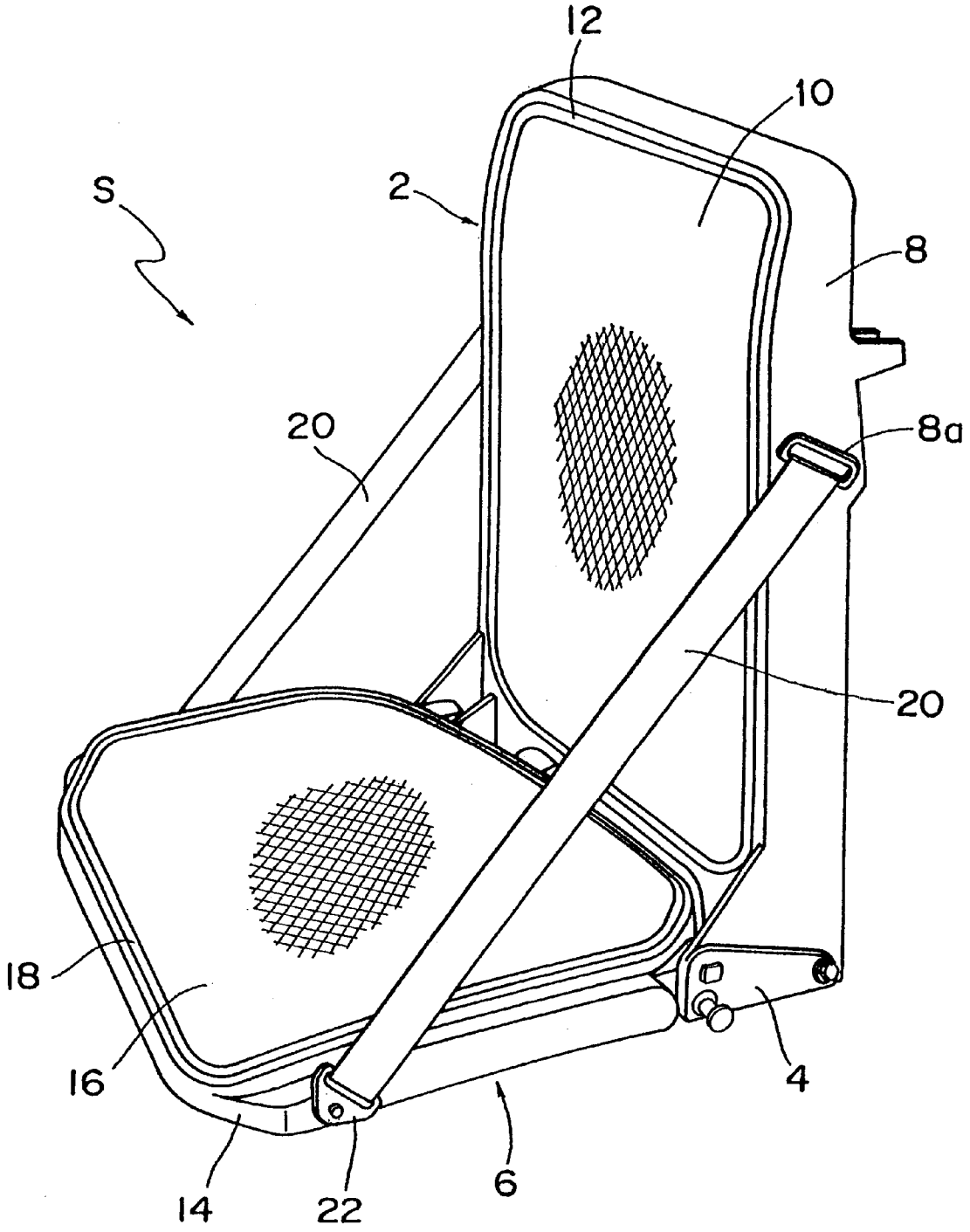
FIG. 1 is a perspective view of a seat provided with a cushioning member having a net-shaped skin according to the present invention.

FIG. 1 depicts a seat S that employs a cushioning member having a net-shaped skin according to the present invention and includes a seat back 2 and a seat cushion 6 rotatably connected to the seat back 2 via a hinge 4.

In the seat S of FIG. 1, each of the seat back 2 and the seat cushion 6 is the cushioning member having a net-shaped skin according to the present invention.

Figure 2:
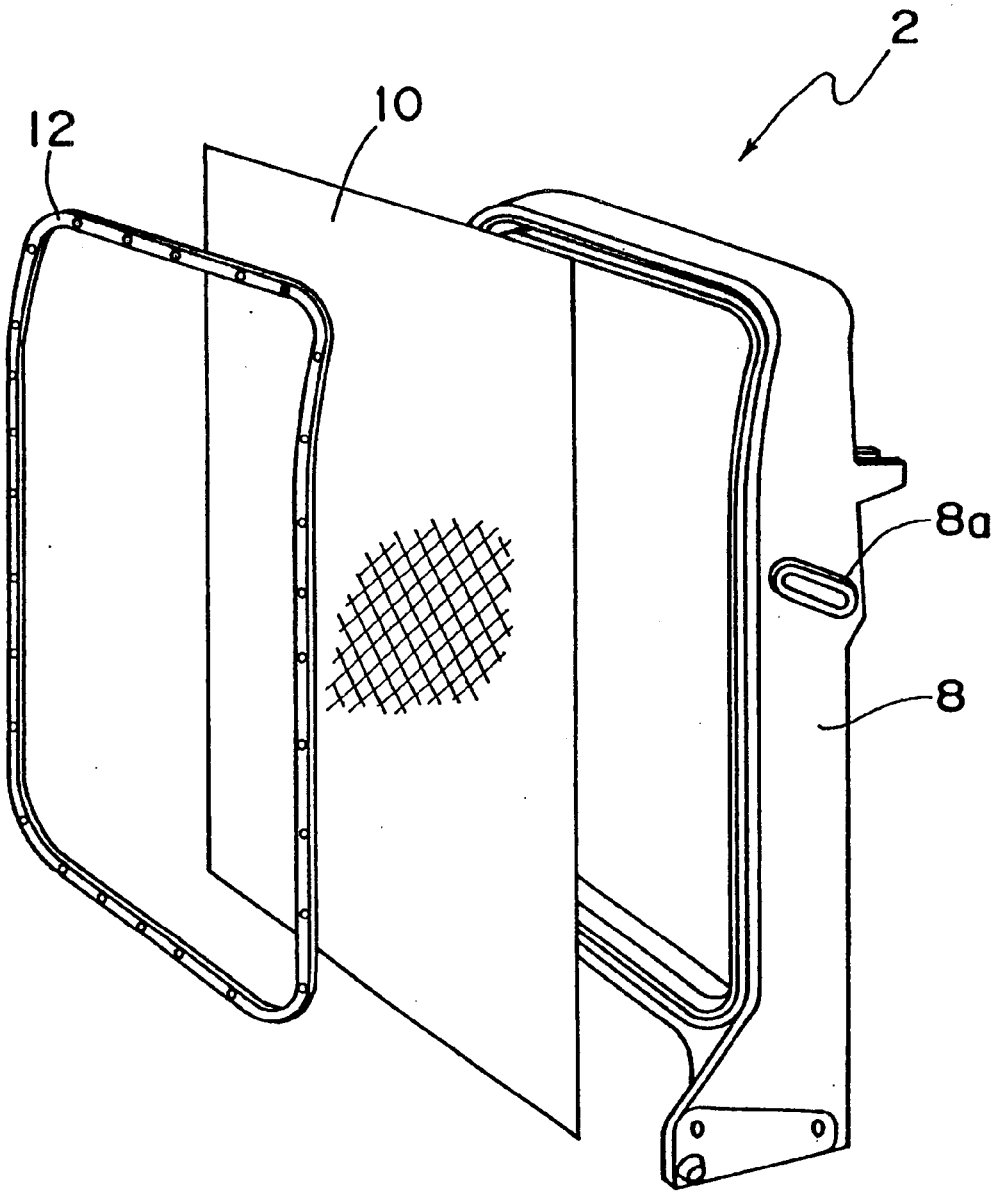
FIG. 2 is an exploded perspective view of a seat back constituting the seat of FIG. 1.

As shown in FIG. 2, the seat back 2 includes a seat back frame 8, a net-shaped skin 10 tensioned over the seat back frame 8, and a holding member 12 for holding the net-shaped skin 10 on the seat back frame 8. The seat back frame 8 has belt holes 8*a*, 8*a* (only one is shown in FIG. 2) defined therein on both sides thereof through which belts described later are drawn into the seat back frame 8.

Like the seat back 2, the seat cushion 6 includes a seat cushion frame 14, a net-shaped skin 16 tensioned over the seat cushion frame 14, and a holding member 18 for holding the net-shaped skin 16 on the seat cushion frame 14.

The seat S also includes belts 20, 20 tensioned on both sides thereof, and each belt 20 has one end engaged with a belt anchor 22 rotatably mounted on the seat cushion frame 14 on one side thereof. The belt 20 is drawn to the inside of the seat back frame 8 through the belt hole 8*a* formed in the seat back frame 8.

Figure 3:
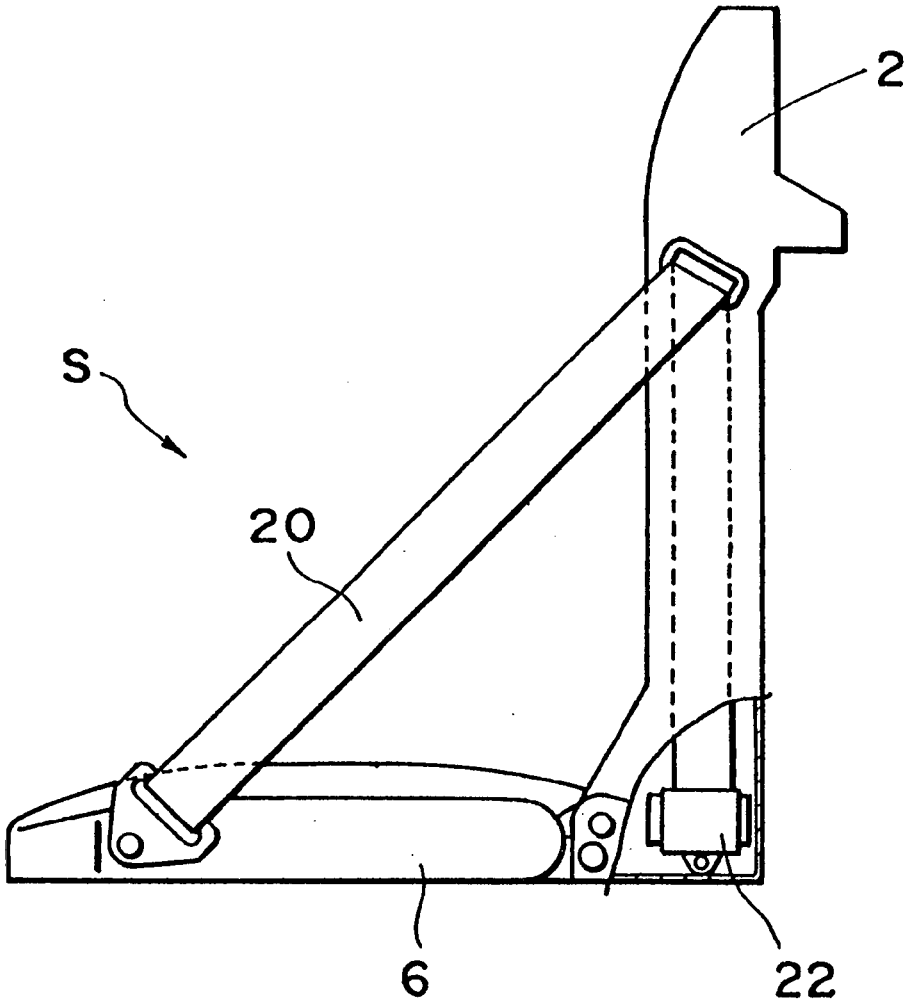
FIG. 3 is a side view, partly in section, of the seat of FIG. 1.

As shown in FIG. 3, refractors 22, 22 are disposed inside the seat back frame 8 on both sides thereof in the vicinity of a lower end thereof, and the other ends of the belts 20, 20 are engaged with the retractors 22, 22, respectively. FIGS. 1 and 3 depict the condition in which a man can sit on the seat with the belts 20, 20 completely drawn out of the retractors 22, 22, respectively. The seat is of a construction in which the load of a seat occupant applied to the seat back 2 is supported by the belts 20, 20.

When the seat is stored and the seat cushion 6 is pushed up, the belts 20, 20 are retracted into the retractors 22, 22 to fold the seat cushion 6 towards the seat back 2.

Figure 4:
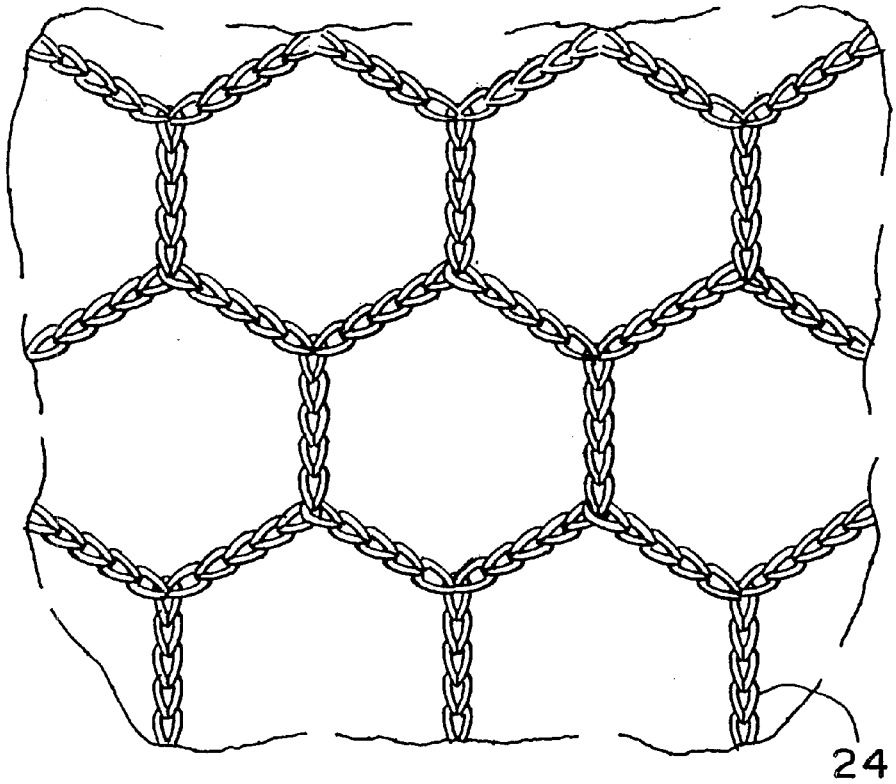
FIG. 4 is a fragmentary front view, on an enlarged scale, of the net-shaped skin.
Figure 5:
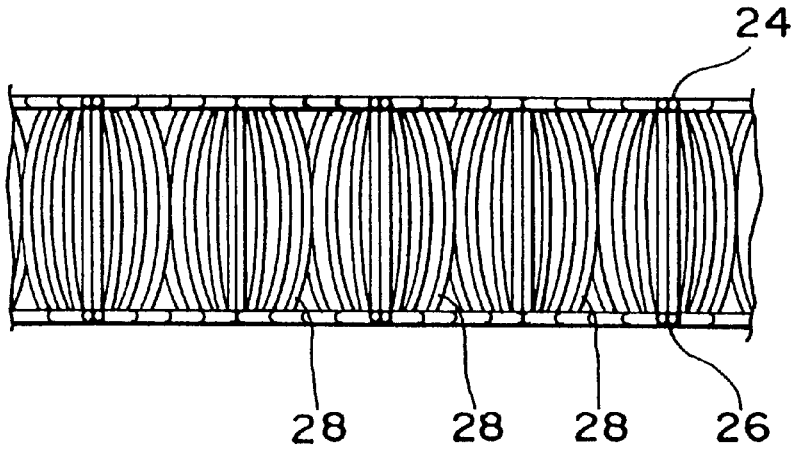
FIG. 5 a fragmentary side view of the net-shaped skin.

FIGS. 4 and 5 depict a three-dimensional mesh knit forming the net-shaped skins 10, 16. A fabric base is formed into a honeycomb-shaped (hexagonal) mesh. The mesh knit is of a three-layered solid truss structure in which an upper mesh layer 24 and a lower mesh layer 26 are connected to each other by a pile layer having a large number of piles 28.

Each yarn of the upper mesh layer 24 and the lower mesh layer 26 is formed by twisting a number of fine threads, while each of the piles 28 is formed of a single thick string to provide the three-dimensional mesh knit with rigidity.

Table 1 shows physical values of materials used for the upper mesh layer 24, the lower mesh layer 26, and the piles 28 forming the pile layer.

TABLE 1

| Item | | Item No. | | | | | |
|---|---|---|---|---|---|---|---|
| | | D80032C | D80050 | D80052 | D80052-B | D80055 | D80053 |
| Material | | Polypropylene | Polyester *A | ← | Polyester | ← | Polyester *A |
| Weight g/m$^2$ | | 663 | 480 | 483 | 496 | 481.6 | 454.4 |
| Density | warp/inch | 7 | 5 | 5 | 6 | 6 | 6 |
| | weft/inch | 14 | 15 | 15 | 15 | 15 | 14 |

TABLE 1-continued

| Item | | Item No. | | | | | |
|---|---|---|---|---|---|---|---|
| | | D80032C | D80050 | D80052 | D80052-B | D80055 | D80053 |
| Fiber | ground | 210d/60f | 150d/48f | ← | ← | 250d/48f | 150d/48f |
| Thickness | pile | 380d/1f | 600d/1f | ← | 600d/1f | ← | 600d/1f |
| (d/f) | | *double | | | | black | black |
| Pull | warp | 41.9 | 10.8 | 10.2 | 15.1 | 29.0 | 11.2 |
| Strength | weft | 20.0 | 5.4 | 6.6 | 6.98 | 14.2 | 9.0 |
| (kg/5 cm) | | | | | | | |
| Elongation | warp | 49.5 | 50.4 | 49.5 | 34.2 | 37.7 | 61.7 |
| (%) | weft | 178.0 | 126.2 | 114.1 | 153.8 | 134.4 | 71.0 |
| Pile Texture | | cross | straight | cross | cross | cross | cross |

In Table 1, "*A" means that the material has been colored to black. Character d represents a denier, and 1*d* is a unit of thickness when 1 gram of thread has been pulled by 9,000 meters. 210*d* is a thickness when 1 gram of thread has been pulled by 9,000/210=42.9 meters. Character f represents a filament that is a unit indicating the number of fine threads forming a yarn, and 60*f* means that a yarn is made of 60 fine threads. The pulling strength "kg/5 cm" is a strength when a mesh having a width of 5 cm has been pulled in the longitudinal direction. Furthermore, "straight" in the pile texture means that hexagons of the upper mesh layer 24 and those of the lower mesh layer 26 completely overlap each other as viewed from above, while "cross" means that they deviate from each other.

Thermoplastic resins are preferably used as the material of the three-dimensional mesh knit, and it is sufficient if the material can be formed into fibers. When textiles are made of such material, it is sufficient if it provides a strength required for a sheet stock. Typical examples are thermoplastic polyester resins such as polyethylene terephthalate (PET), polybutylene terephthalate (PBT), etc., polyamide resins such as nylon 6, nylon 66, etc., polyolefin resins such as polyethylene, polypropylene, etc., and resins in which more than two kinds of such resins are mixed.

The fiber thickness of each pile 28 is greater than 380*d* and, preferably, greater than 600*d* so that the load of a seat occupant applied to the three-dimensional mesh knit can be supported by deformation of the hexagonal meshes and by inclination of the piles, thereby providing a soft structure that causes no stress concentration.

Methods in which the seat back frame 8 and the net-shaped skin both constituting the seat back 2 are joined are explained hereinafter.

In the first method, after both the seat back frame 8 and the holding member 12 have been made of a thermoplastic resin, the net-shaped skin 10 is placed between the seat back frame 8 and the holding member 12 and is joined thereto by vibration welding.

However, the holding member 12 is not always required, and the seat back frame 8 and the net-shaped skin 10 can be directly joined together by vibration welding.

The vibration welding makes use of frictional heat to fuse thermoplastic resins. The frictional heat is produced by pressing two parts to be welded to each other and by simultaneously imparting vibration of a several-millimeter width to the welding surface. In general, when the vibration is stopped after a lapse of two or three seconds, the two parts automatically return to their original positions without any positional deviations, and subsequent about 1-second cooling results in high-strength welding.

The vibration welding has the advantages of short cycle, low power consumption and no smell, and is applicable to complicated or irregular configurations. In addition, the positioning between parts is possible and the welding of a number of parts at one time is also easily possible. Moreover, the vibration welding enables welding of different materials and is also characterized by high-strength welding irrespective of water absorption properties and hardness.

The vibration welding is generally utilized to join plate-like members together, but is utilized, in the practice of the present invention, to join by fusing fibers into a plate-like member.

Figure 6:
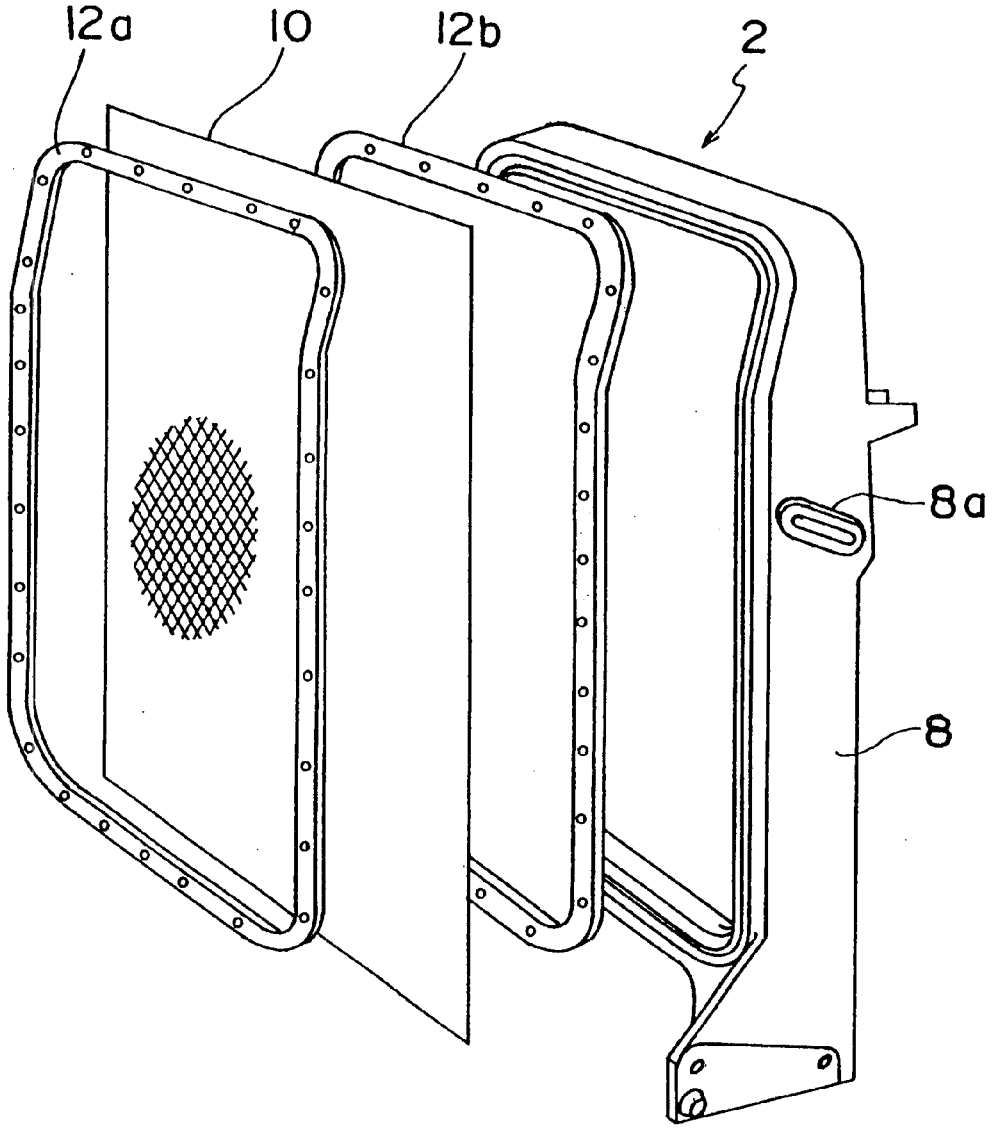
FIG. 6 is an exploded perspective view of a modified form of the seat back.

In FIG. 6, while a pair of holding members 12*a*, 12*b* are made of a thermoplastic resin, the seat back frame 8 is made of a metal such as iron. The net-shaped skin 10 is placed between the holding members 12*a*, 12*b* and joined thereto by vibration welding, and is subsequently screwed to the metal seat back frame 8.

The use of the metal seat back frame 8 increases the rigidity of the seat back, which is therefore applicable to an automotive seat or the like to which an impact load is applied. If the net-shaped skin 10 becomes unusable, it is advantageous in that the holding members 12*a*, 12*b* and the net-shaped skin 10 can be replaced together.

It is to be noted that after the net-shaped skin 10 has been joined to any one of the holding members 12*a*, 12*b* by vibration welding, it can be screwed to the metal seat back frame 8. In this case, of the holding members 12*a*, 12*b*, the one to which the net-shaped skin 10 has not been joined can be removed.

Figure 7:
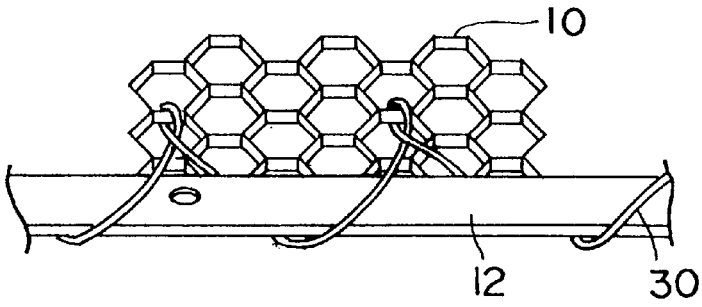
FIG. 7 is a fragmentary perspective view depicting how to join the net-shaped skin to a holding member.
Figure 8:
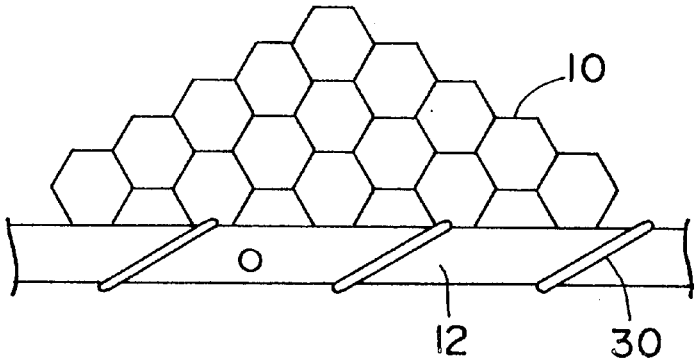
FIG. 8 is a fragmentary front view of the net-shaped skin and the holding member of FIG. 7 after joining.
Figure 9:
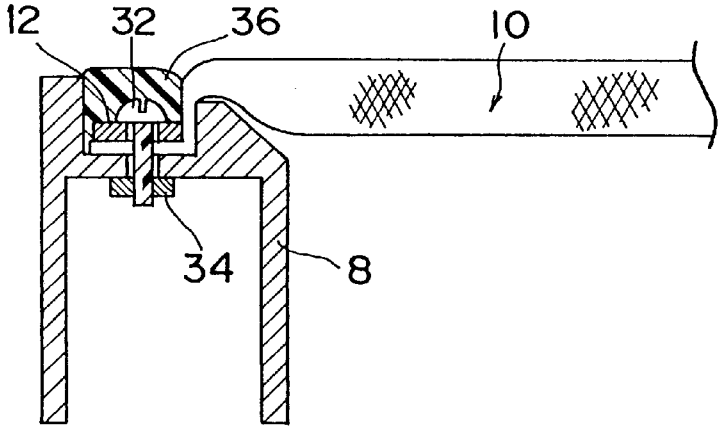
FIG. 9 is a fragmentary sectional view of the seat back when the net-shaped skin and the holding member have been secured to a frame.

FIGS. 7 to 9 depict the second joining method.

As shown in FIGS. 7 and 8, an edge treatment is carried out by passing a string (or a thread) 30 through edge portions of the upper mesh layer 24 and the lower mesh layer 26 of the net-shaped skin 10 at predetermined intervals to fix the net-shaped skin 10 to the holding member 12. Thereafter, as shown in FIG. 9, the holding member 12 is secured to the seat back frame 8 by means of bolts 32 and nuts 34. Head portions of the bolts 32 are covered with, for example, a resinous cover 36.

It is to be noted that the string 30 is not always passed through both the upper mesh layer 24 and the lower mesh layer 26, and may be passed through only one of them.

Figure 10:
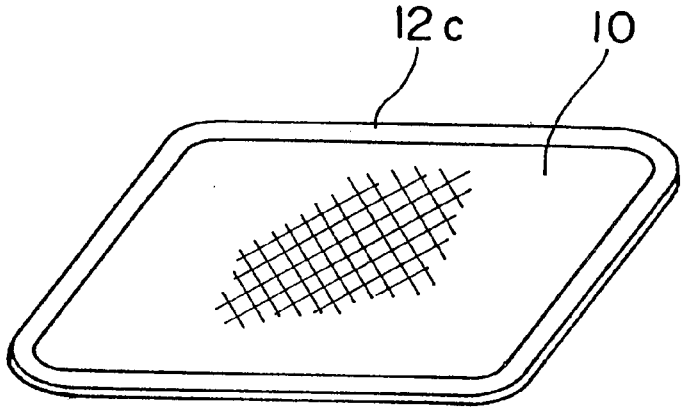
FIG. 10 a perspective view of the net-shaped skin and the holding member joined together by another joining method.
Figure 11:
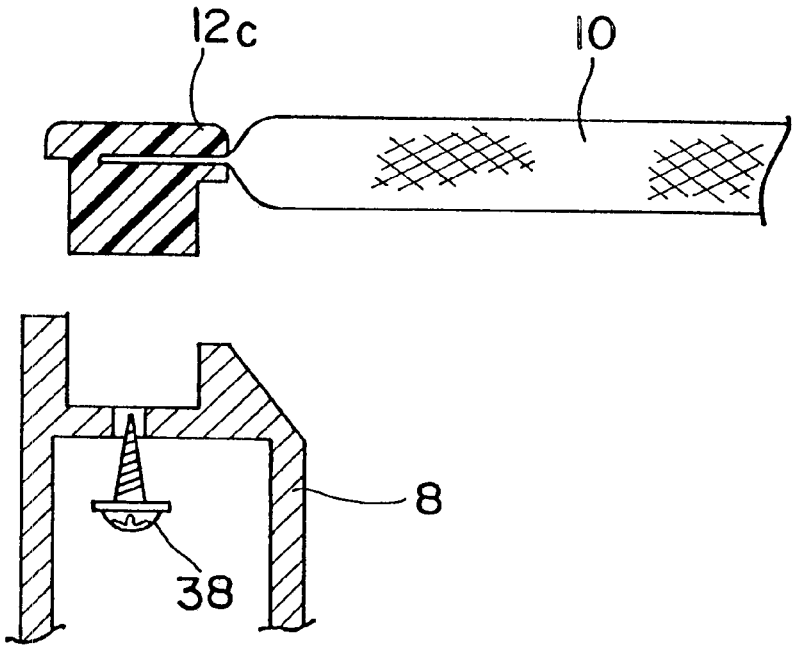
FIG. 11 is a fragmentary sectional view of the seat back when the net-shaped skin and the holding member of FIG. 10 is secured to the frame.

FIGS. 10 and 11 depict the third joining method.

According to this method, a resinous frame 12*c* is first formed along the circumference of the net-shaped skin 10 by insert molding, and is subsequently secured to the seat back frame by means of screws 38.

Because the joining method for parts of the seat cushion 6 is the same as the joining method for the seat back 2 referred to above, description thereof is 3 omitted.

Figure 12:
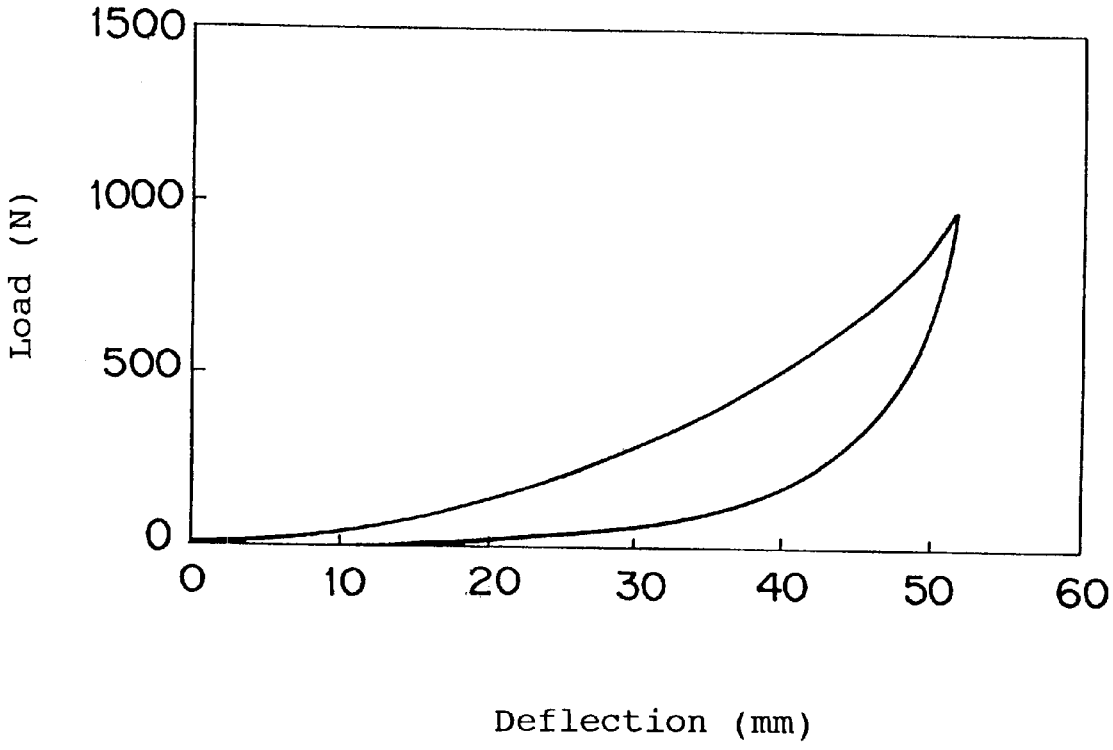
FIG. 12 is a graph showing a load-deflection curve of a three-dimensional mesh knit employed in the net-shaped skin.

FIG. 12 depicts a load-deflection curve of a three-dimensional mesh knit employed in the net-shaped skins 10, 16.

This curve is a curve obtained by cutting off the three-dimensional mesh knit so as to have a circumferential length of 653 mm and by pressing a ϕ76-plait against it. This curve is a smooth non-linear curve compared with a curve of elastic material such as urethane. Because the three-dimensional mesh knit has a large hysteresis, when it is employed in an automotive seat, it can absorb external vibration energy effectively.

Figure 13:
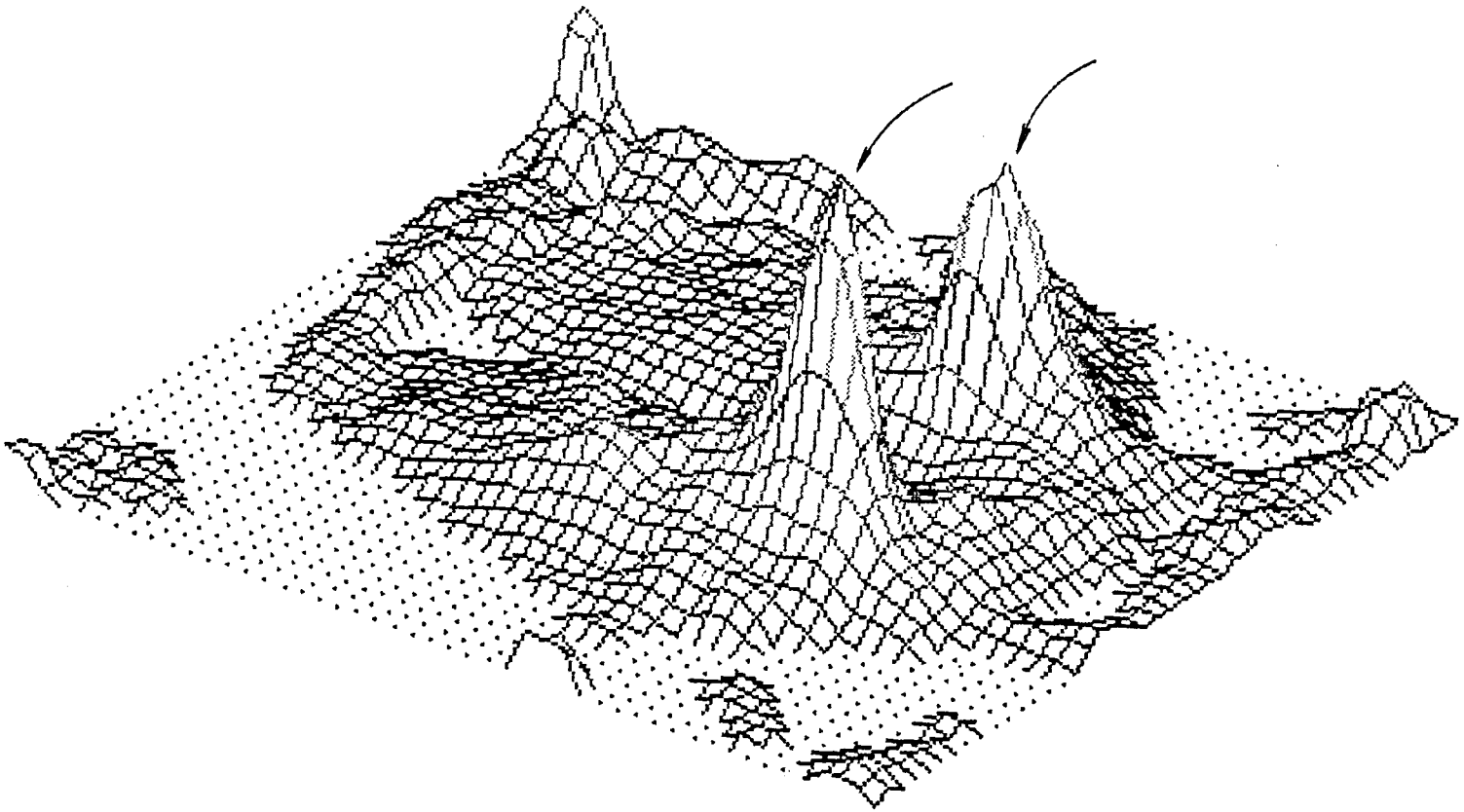
FIG. 13 is a graph showing a body pressure distribution when a subject weighing 37 kg has on a conventional seat cushion.
Figure 14:
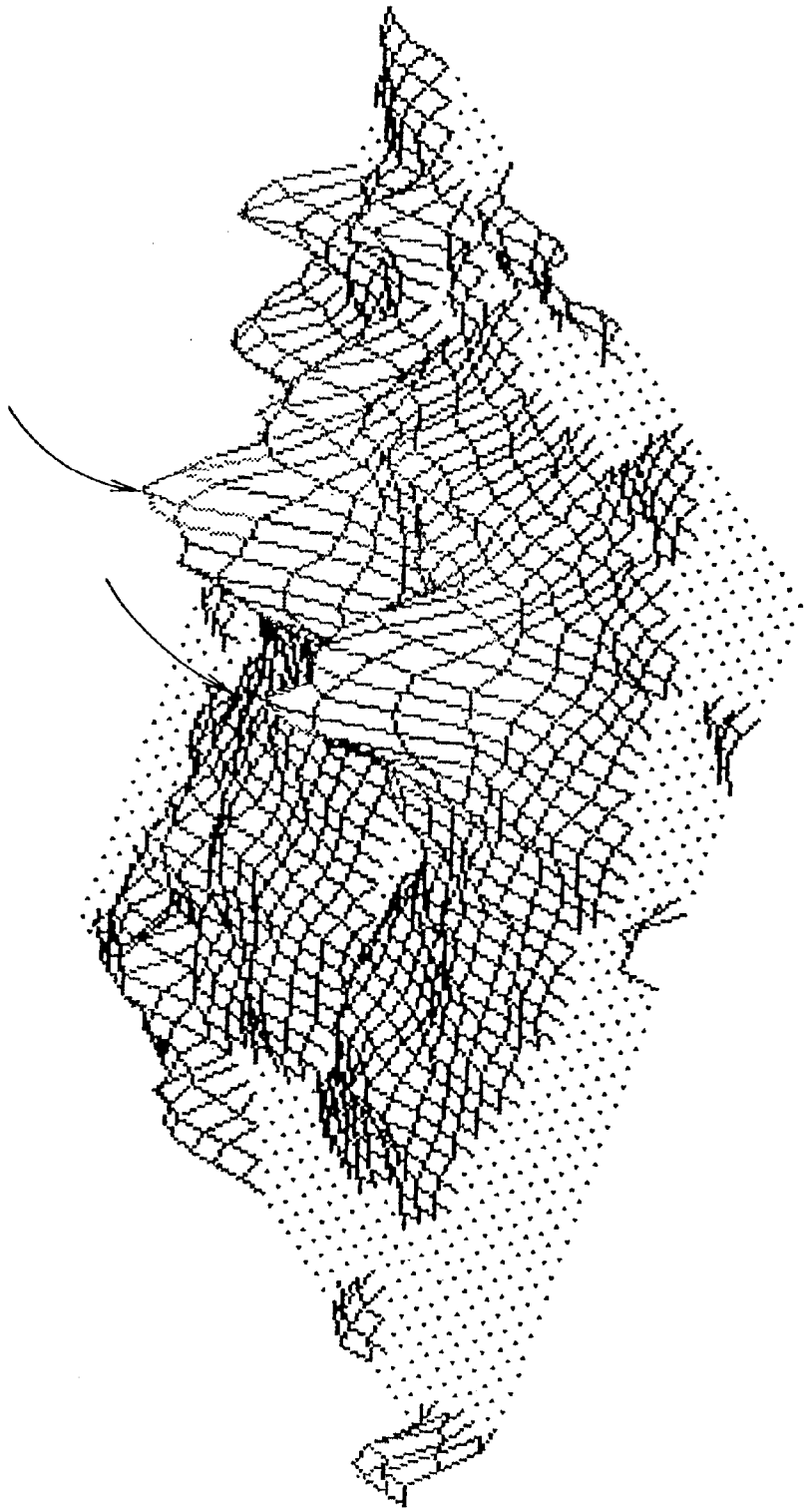
FIG. 14 is a graph showing a body pressure distribution when the subject weighing 37 kg has sat on the seat cushion according to the present invention.
Figure 15:
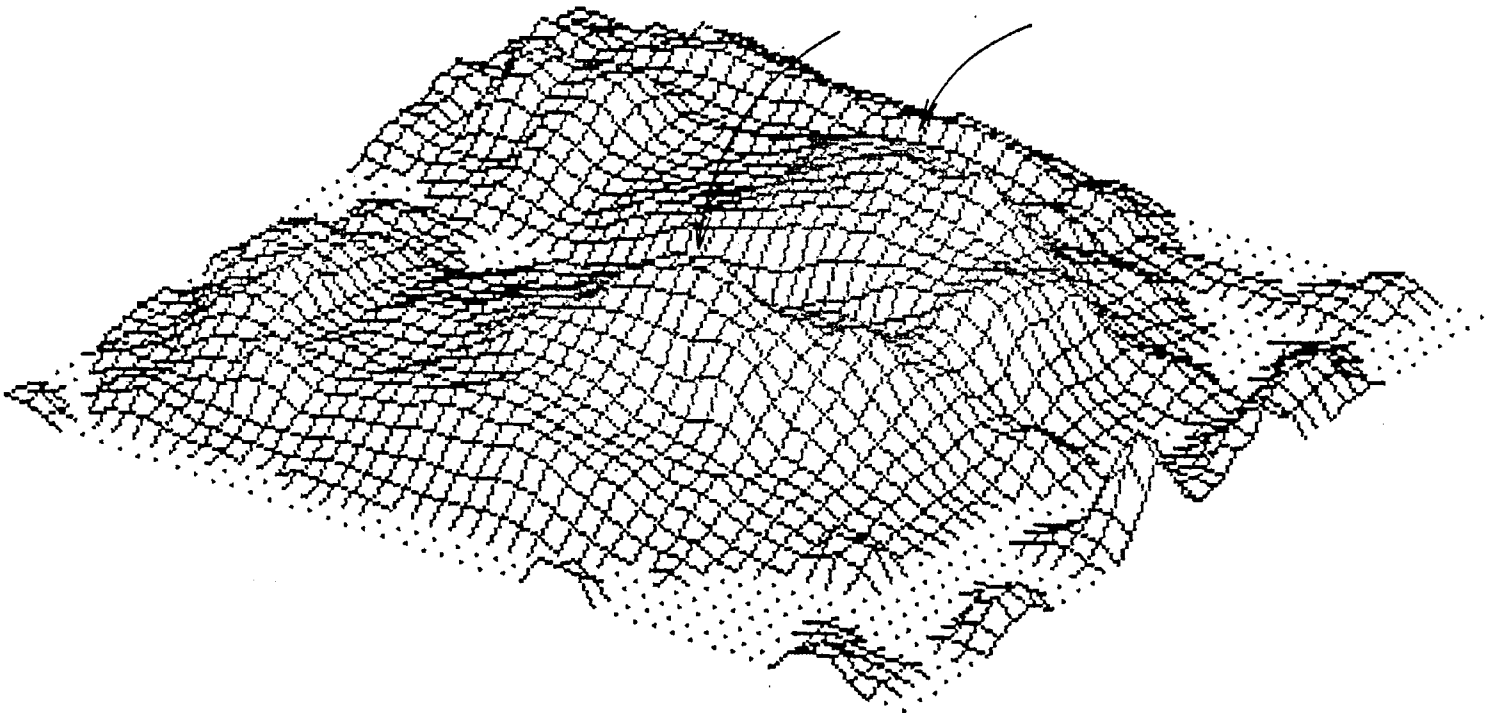
FIG. 15 is a graph showing a body pressure distribution when a subject weighing 93 kg has sat on the conventional seat cushion.
Figure 16:
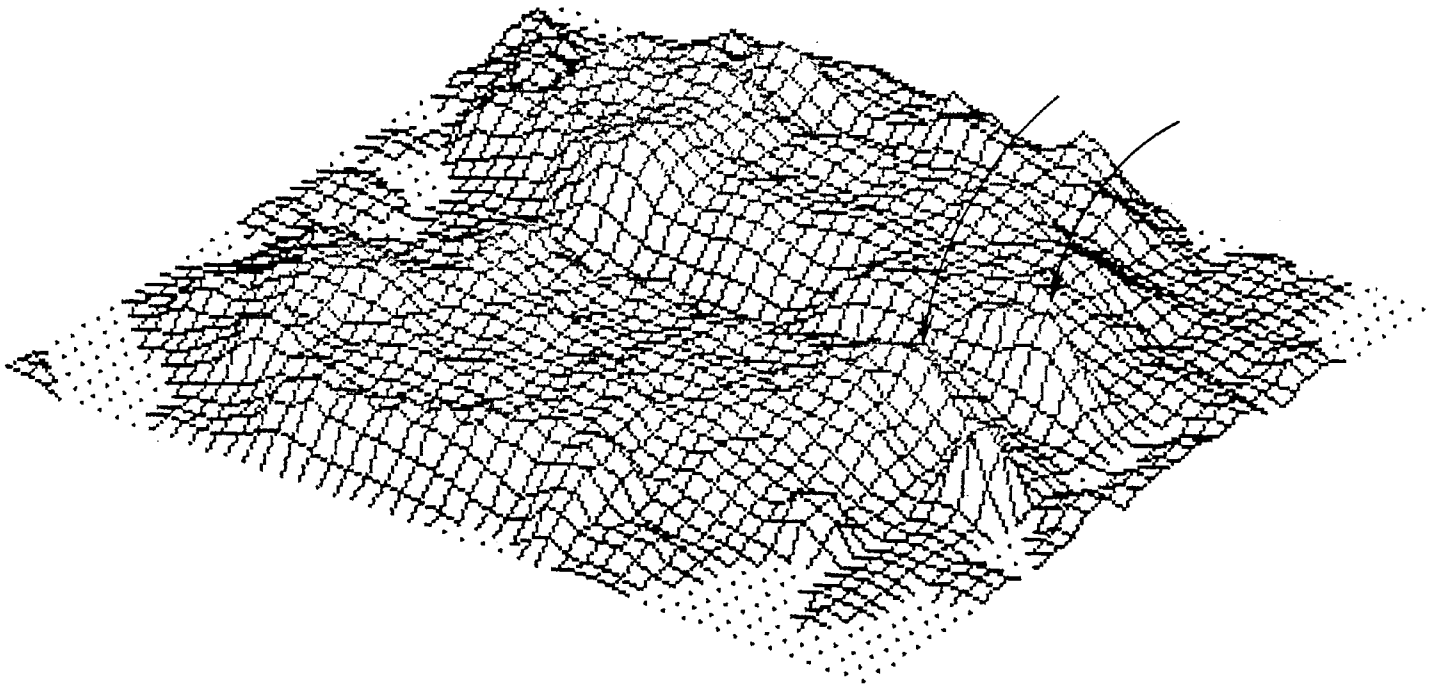
FIG. 16 is a graph showing a body pressure distribution when the subject weighing 93 kg has sat on the seat cushion according to the present invention.

FIGS. 13 to 16 show body pressure distributions when a subject has sat on a conventional seat cushion and on a seat cushion employing a cushioning member according to the present invention. FIGS. 13 and 14 show the body pressure distributions when a subject weighing 37 kg has sat on the conventional seat cushion and on the seat cushion employing the cushioning member according to the present invention, respectively, while FIGS. 15 and 16 show the body pressure distributions when a subject weighing 93 kg has sat on the conventional seat cushion and on the seat cushion employing the cushioning member according to the present invention.

In the conventional seat cushion, urethane pads are partially fitted to a warp- and weft-knitted fabric in the form of a belt at positions where a feeling of foreign substances is sensed or the support pressure changes.

As shown in FIGS. 13 and 14, when the subject weighing 37 kg has sat on the seat cushions, peak values (arrows) of a load applied to the seat cushion employing the cushioning member of the present invention were considerably reduced as compared with peak values (arrows) of a load applied to the conventional seat cushion. Actual measurements revealed that the peak values were reduced by nearly about one third.

As shown in FIGS. 15 and 16, when the subject weighing 93 kg has sat on the seat cushions, peak values (arrows) of a load applied to the seat cushion employing the cushioning member of the present invention were also considerably reduced as compared with peak values (arrows) of a load applied to the conventional seat cushion. Actual measurements revealed that the peak values were reduced by nearly about one third.

Furthermore, because the cushioning member of the present invention employing the three-dimensional mesh knit as the net-shaped skin includes the honeycomb-shaped upper and lower mesh layers 24, 26 and a large number of piles 28 each made of a single thick string, and is of a truss structure, it has the following advantages.

(1) Because each pile is elastic, the hardness, elasticity or fitness can be controlled by changing the quality of the material, fiber thickness, texture or physical characteristics thereof.

(2) By making use of the shape memory function of the honeycomb shape, the restoring capability and the resistance to deformation can be both enhanced.

(3) The truss structure makes it possible to provide a thin and hard-to-deform elastic structure having good pressure dispersing and moderating capabilities and improved fitness.

(4) Because the cushioning member is of a uniform honeycomb-shaped truss structure in which each part is independent, it is excellent in body pressure dispersion (low and uniform body pressure distribution) and can accommodate physical differences. For thin and fleshless men, the cushioning member can prevent a frontward slip by concentrating, at low pressures, the body pressure on the tuber ischiadicum that is relatively insensitive to fatigue. Also, the cushioning member is excellent in weight movement and easy to change the attitude, and reduces the frictional shear force.

(5) The honeycomb-shaped truss structure does not bring about the state similar to a hammock (the state in which pressures are locally concentrated and strong side pressures are received), enables a user to take a natural attitude, and reduces a feeling of foreign substances by the effect of the elastic honeycomb structure.

(6) The honeycomb-shaped truss structure provides a porous structure that is excellent in permeability to air and permeability to water vapor.

(7) The honeycomb-shaped truss structure enlarges the support (contact) area. Although the user is supported over the whole support area, he is locally supported by each of the yarns forming the honeycomb shape. Accordingly, the honeycomb-shaped structure does not become stuffy.

(8) Without an outermost layer of the skin and without any pads, a feeling of foreign substances is reduced by the framed thin and highly elastic member.

(9) The honeycomb-shaped truss structure increases the strength.

Because the cushioning member having the net-shaped skin according to the present invention has the above-described features, when it is employed in, for example, a seat, it prevents hematogeous troubles around femoral regions, neuropathy, lumber troubles, etc., optimizes sweating or skin temperatures, and protects muscular tissues.

Although in the above-described embodiment the cushioning member shaving the net-shaped skin according to the present invention is employed in both the seat cushion and the seat back, it may be employed in only one of them. Also, the cushioning member of the present invention can be employed in a head rest mounted on the seat back, a bed, or the like.

Furthermore, because the cushioning member of the present invention is soft to sit on and has a soft spring constant in a region to be normally used, it does not easily transmit vibration even if it is thin and has a high rigidity. Accordingly, the cushioning member of the present invention can be employed in an automotive seat and also in a seat for a motorcycle because it is of the all-weather type.

Because the cushioning member of the present invention includes various modifications, they are explained hereinafter.

Figure 17:
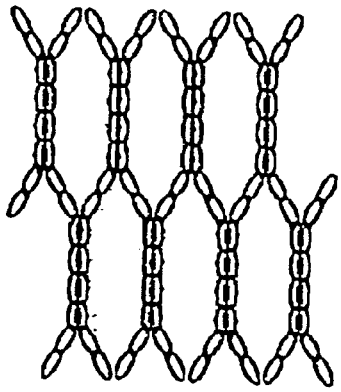
FIG. 17 schematically depicts several fabric base textures used for upper and lower mesh layers, (*a*) depicting a honeycomb-shaped (hexagonal) mesh shown in FIG. 4, (*b*) depicting a diamond-shaped mesh, and (*c*) depicting a chain-inserted texture.
Figure 17:
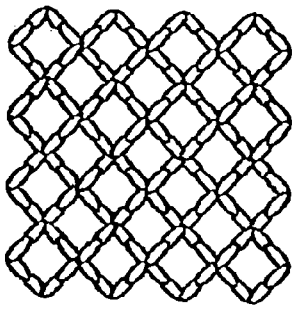
Figure 17:
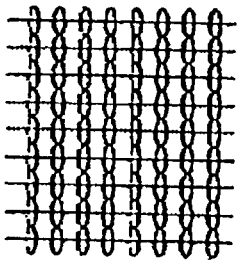

FIG. 17 schematically depicts several fabric base textures used for the upper and lower mesh layers 24, 26, (*a*) depicting a honeycomb-shaped (hexagonal) mesh shown in FIG. 4, (*b*) depicting a diamond-shaped mesh, and (*c*) depicting a chain-inserted texture.

Figure 18:
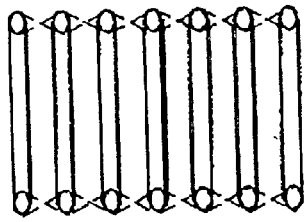
FIG. 18 schematically depicts pile textures connecting the upper and lower mesh layers, (*a*) depicting a generally straight texture corresponding to FIG. 5, (*b*) depicting a generally straight texture in the form of a figure "8", (*c*) depicting a cross texture and (*d*) depicting a cross texture in the form of a figure "8".
Figure 18:
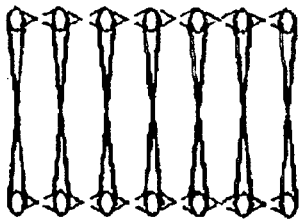
Figure 18:
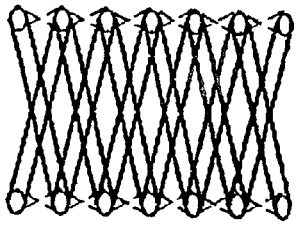
Figure 18:
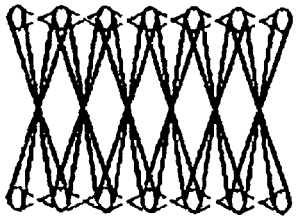

FIG. 18 schematically depicts pile textures connecting the upper and lower mesh layers 24, 26, (*a*) depicting a generally straight texture corresponding to FIG. 5, (*b*) depicting a generally straight texture in the form of a figure "8", (*c*) depicting a cross texture, and (*d*) depicting a cross texture in the form of a figure "8".

Figure 19:
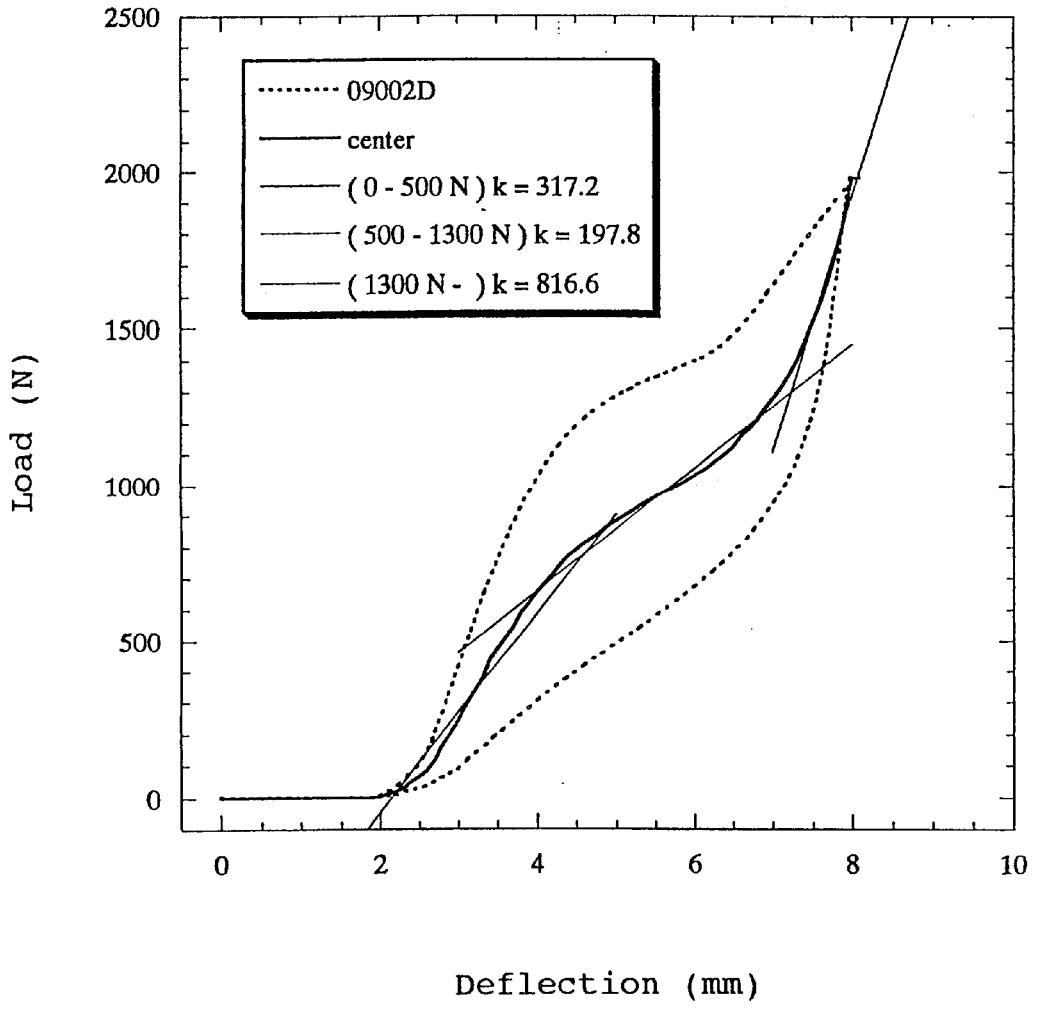
FIG. 19 is a graph showing static characteristics when a disc has been pressed against a cushioning member according to the present invention.
Figure 20:
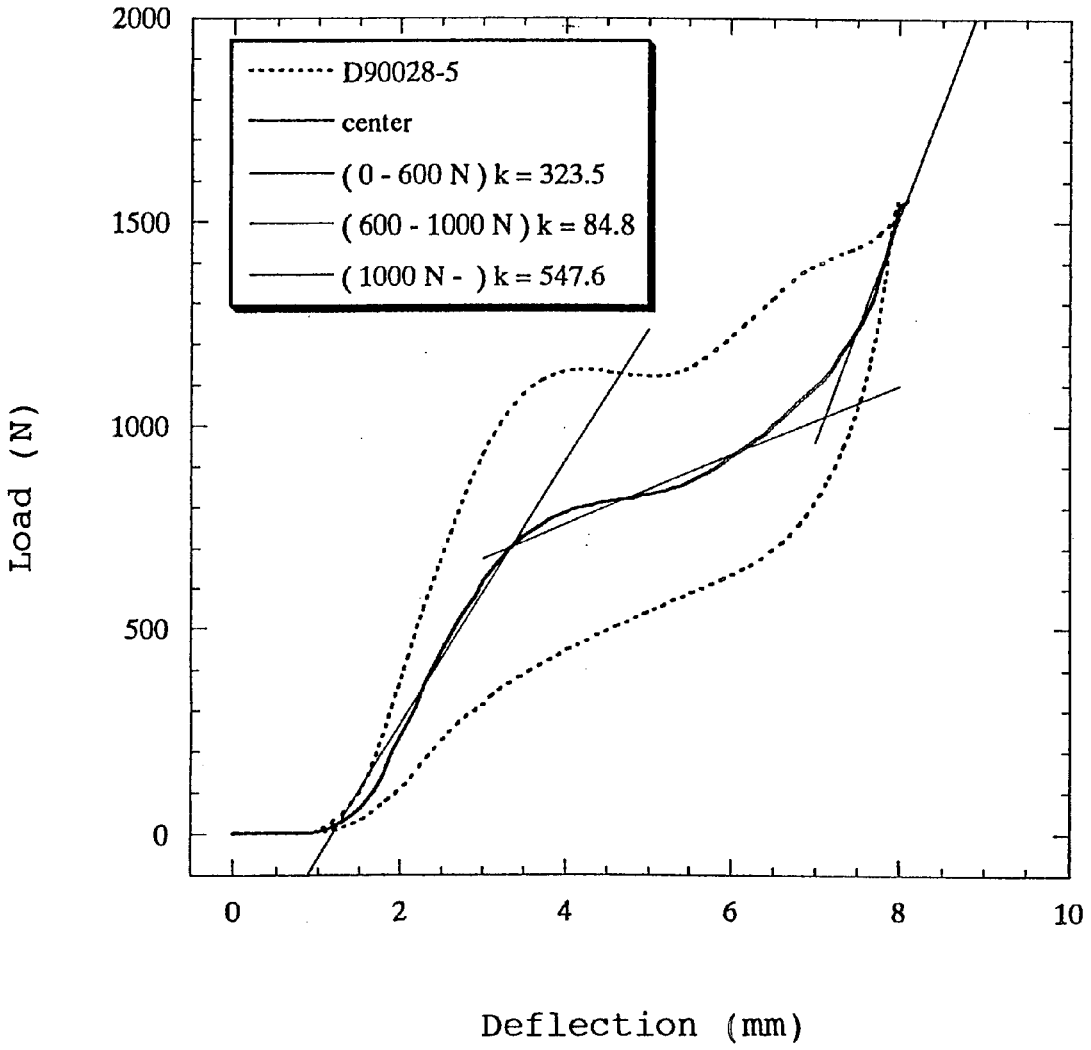
FIG. 20 is a graph showing static characteristics when the disc has been pressed against another cushioning member according to the present invention.

FIGS. 19 and 20 are graphs each showing static characteristics when a disc (ϕ200) has been pressed against the cushioning member having the net-shaped skin according to the present invention. The fabric base texture of the honeycomb-shaped mesh shown in FIG. 17(*a*) is employed in the upper mesh layer 24, while the fabric base texture of the chain-inserted texture shown in FIG. 17(*c*) is employed in the lower mesh layer 26. The pile texture includes the generally straight texture of FIG. 18(*a*) as viewed in one direction and the cross texture of FIG. 18(*c*) as viewed in a direction perpendicular to said one direction. Items 09002D and D90028-5 (details thereof are described later) are used for the net-shaped skin.

As can be seen from the graphs of FIGS. 19 and 20, the following relationship is established:

$$k3>k1>k2$$

where k1 is a spring constant in a small-load region, k2 a spring constant in a normal use region around a balanced point, and k3 a spring constant in a large-load region. The spring constant in the normal use region can be set to the smallest one.

In the above-described formula, when the load applied to the net-shaped skin is small, deformation of the fabric base texture of the upper mesh layer 24 has a great influence on the static characteristics, and the upper mesh layer greatly contributes to the spring constant k1. In the normal use region or the large-load region, upon deformation of the upper mesh layer 24, deformation of the pile layer greatly contributes to the spring constants k2 and k3. In particular, the cross texture formed in the pile texture in the specific direction provides a rigidity sufficient to secure a space between the upper and lower mesh layers when a predetermined load is applied thereto.

Table 2 shows physical values of the material used for the upper mesh layer 24, the lower mesh layer 26 and the piles 28 forming the pile layer, and those of other various materials.

TABLE 2

| Item | | Item No. 09001-D | 09002D | 09006D | D80053-2 | D90028-5 |
|---|---|---|---|---|---|---|
| Material | | Polyester | ← | ← | ← | ← |
| Weight g/m$^2$ | | 1027 | 1101 | 1280 | 784 | 840 |
| Density | warp/inch | 7 | 8 | 8 | 7.5 | 10 |
| | weft/inch | 15 | 15 | 14 | 13 | 14 |
| Fiber Thick. | ground | 1300d/96f | 1300d/96f | 1300d/96f | 1300d/96f | ← |
| (d/f) | | | 500d/70f | | 500d/70f | ← |
| | pile | 800d/1f | ← | ← | 600d/1f | ← |
| Pull Strength | warp | 129.2 | 156.8 | 96.7 | 156.9 | 201.1 |
| (kg/5 cm) | weft | 89.0 | 68.6 | 143.2 | 62.1 | 121.1 |
| Elongation | warp | 68.2 | 70.0 | 73.1 | 56.2 | 47.9 |
| (%) | weft | 98.4 | 96.6 | 65.0 | 66.4 | 102.8 |
| Tear Strength | warp | 87.5 | 96.2 | 87.0 | 87.9 | 99.9 |
| (kg) | weft | 63.7 | 54.8 | 82.5 | 49.2 | 70.3 |
| Load (*1) | thick. mm | 11.1 | 11.7 | 12.3 | — | — |
| 200 g/cm$^2$ | compress. % | 16.2 | 13.3 | 11.6 | — | — |
| Ordinary State | elasticity % | 92.6 | 91.3 | 89.9 | — | — |
| Strain After | warp | 2.8 | 1.6 | 2.5 | 2.6 | 2.3 |
| Repeated Load (%) | weft | 2.0 | 5.2 | 1.8 | 10.6 | 10.6 |
| Surface | warp | 4.5 | 3.5 | 4 | 4.5 | 4.5 |
| Wearability Grade | weft | 4 | 3.5 | 4 | 4 | 4 |
| Fastness to Light | 150H | 4.5 | 4.5 | 4.5 | — | — |
| Grade | 250H | 4 | 4.5 | — | | |
| Fastness to | dry cloth | 4.5 | 4.5 | 4.5 | — | — |
| Rubbing Grade | wet cloth | 4.5 | 4.5 | 4.5 | | |

Figure 21:
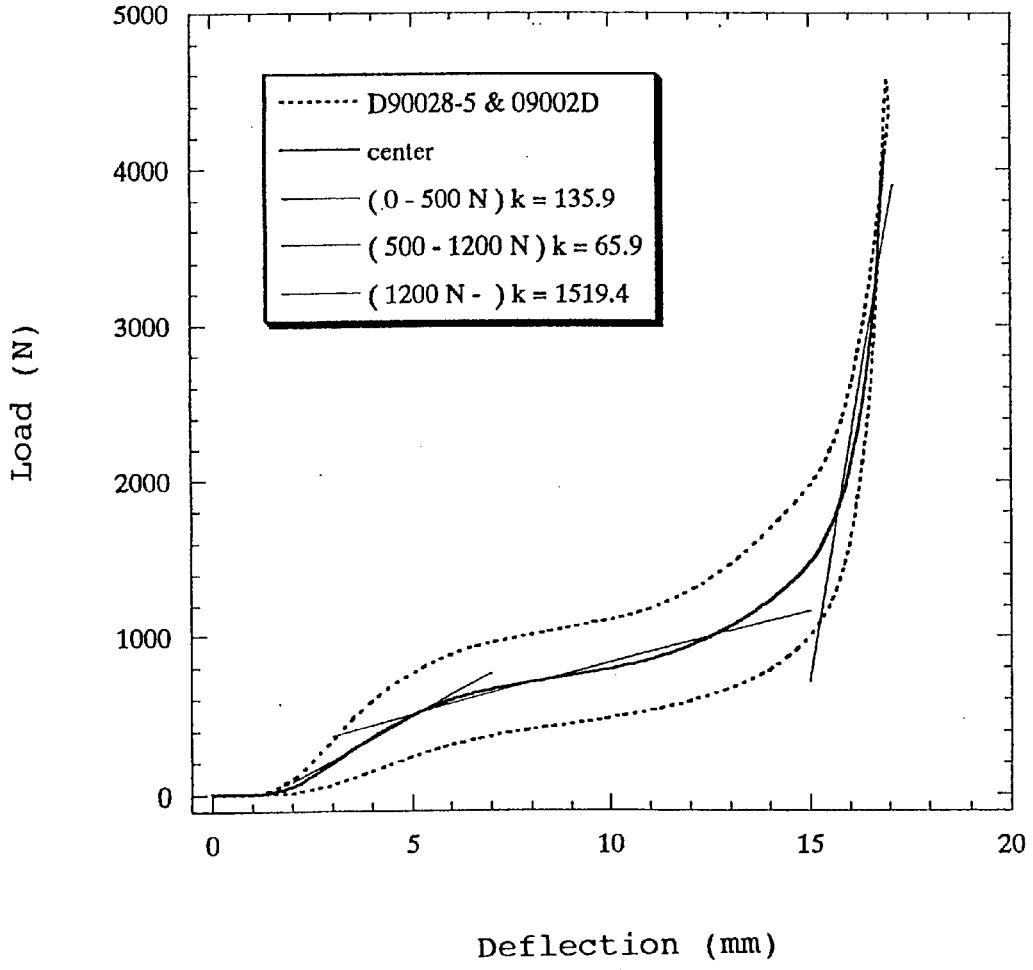
FIG. 21 is a graph showing static characteristics of a laminated structure that has the cushioning member showing the static characteristics of FIG. 19 and the cushioning member showing the static characteristics of FIG. 20.

Remarks (*1):
Sample Size 50 × 50 mm
Loading Time 10 minutes
Shelf Time 10 minutes FIG. 21 shows static characteristics when the net-shaped skin showing the static characteristics of FIG. 19 and the net-shaped skin showing the static characteristics of FIG. 20.have been laminated. The lamination reduces the spring constant as a whole and, hence, the spring constant can be freely controlled by increasing the number of lamination. Also, the stroke to a bottom end increases, and the load applied to each of the piles reduces, thereby reducing the bottom-end shock.

Figure 22:
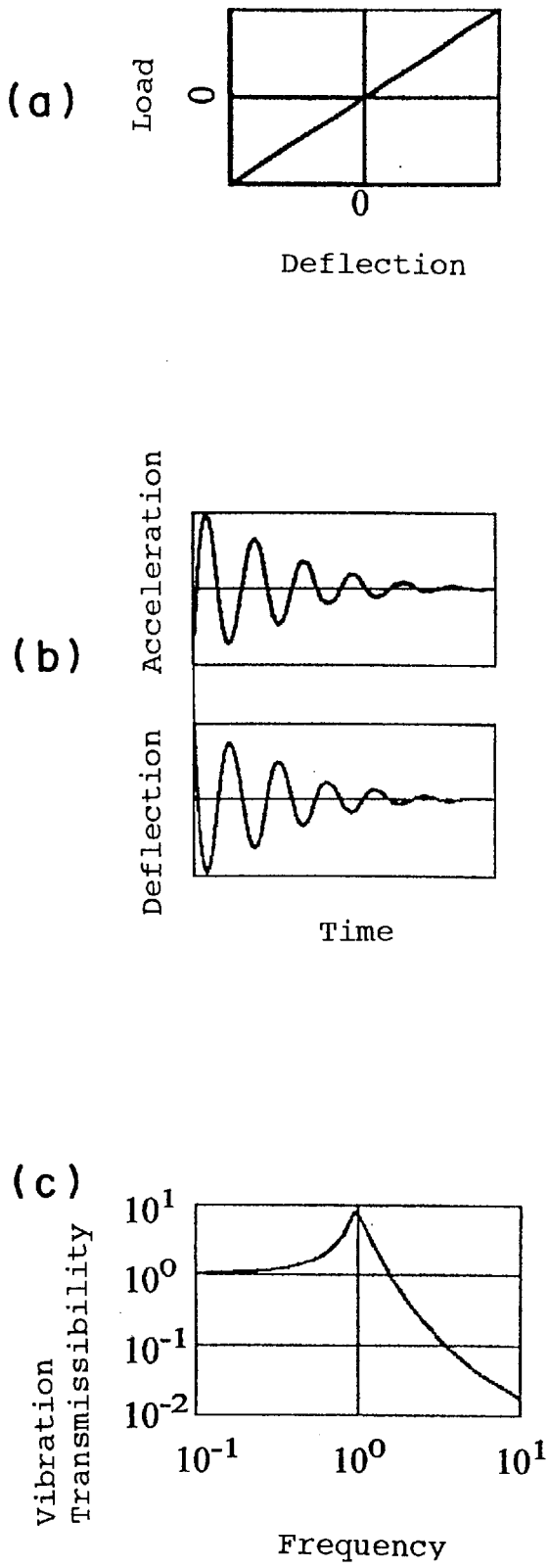
FIG. 22 depicts several characteristics of a linear spring system, (*a*) depicting load-deflection characteristics, (*b*) depicting transient response characteristics, and (*c*) depicting frequency response characteristics.
Figure 23:
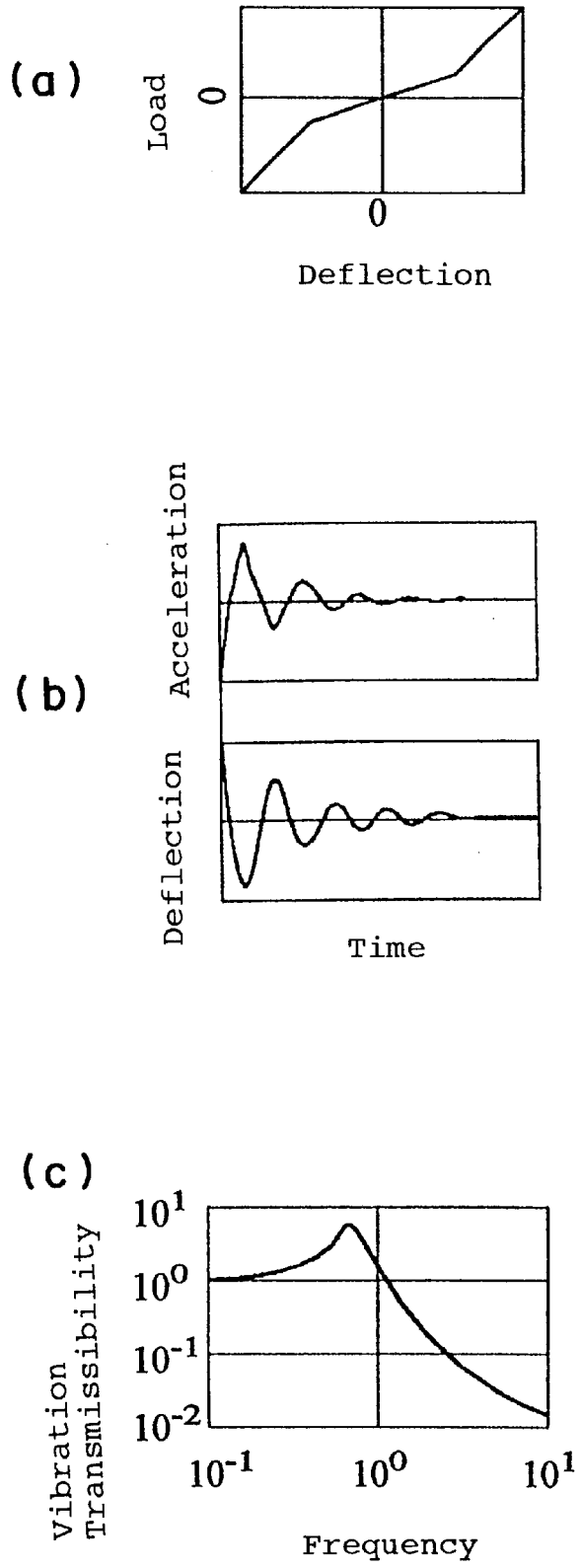
FIG. 23 depicts several characteristics of a non-linear spring system, (*a*) depicting load-deflection characteristics, (*b*) depicting transient response characteristics, and (*c*) depicting frequency response characteristics.
Figure 24:
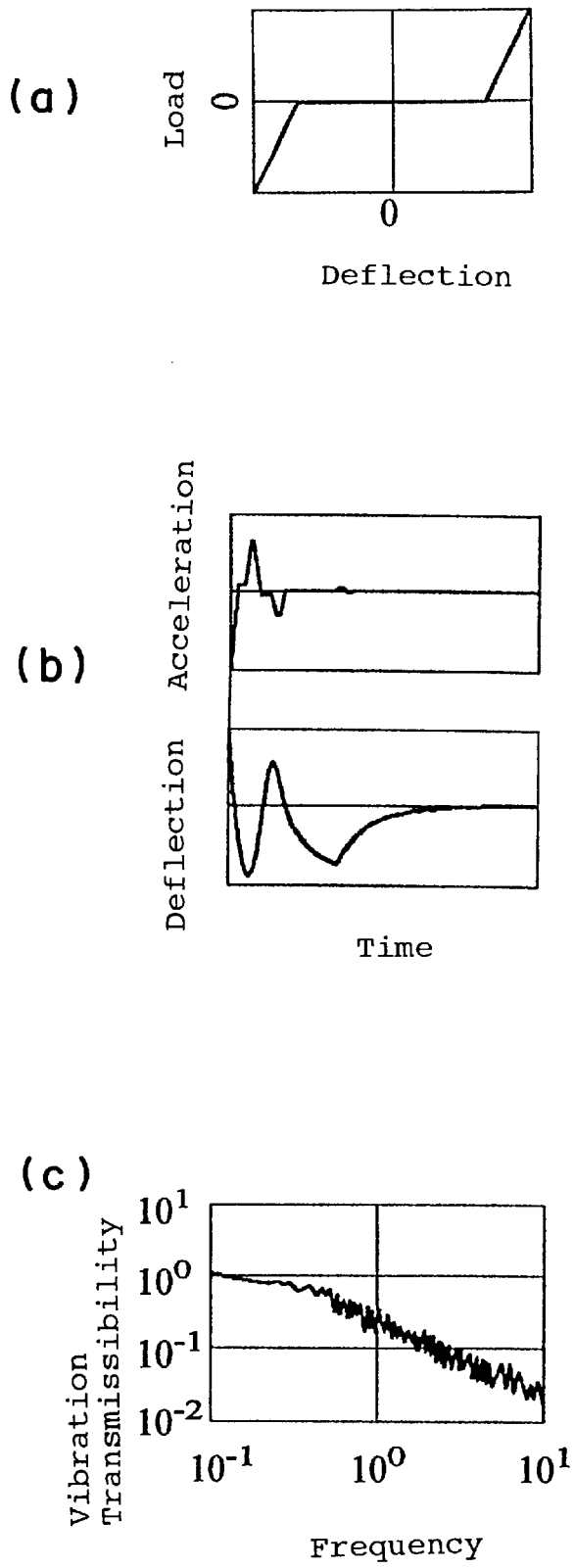
FIG. 24 depicts several characteristics of another non-linear spring system, (*a*) depicting load-deflection characteristics, (*b*) depicting transient response characteristics, and (*c*) depicting frequency response characteristics.

Graphs shown in FIGS. 22 to 24 schematize a relationship among load-deflection characteristics, transient response characteristics, and frequency response characteristics. The transient response and the frequency response of a non-linear spring system of FIGS. 23 and 24 are improved as compared with those of a linear spring system of FIG. 22.

More specifically, in the non-linear spring system having a smaller spring constant around the balanced point than that of the linear spring system, the acceleration and deflection are attenuated quickly with respect to input changes and the period of time to the steady state is short. This tendency becomes conspicuous with a reduction in spring constant around the balanced point. Because the resonant frequency is given by:

$$f_0=1/2\pi\sqrt{k/m},$$

the resonant frequency is shifted to the low-frequency side as the spring constant around the balanced point reduces. That is, the resonant frequency is reduced by softening the spring constant, and the acceleration and deflection are attenuated even without any damper. When the spring constant is zero, resonant points disappear completely and attenuation starts.

Figure 25:
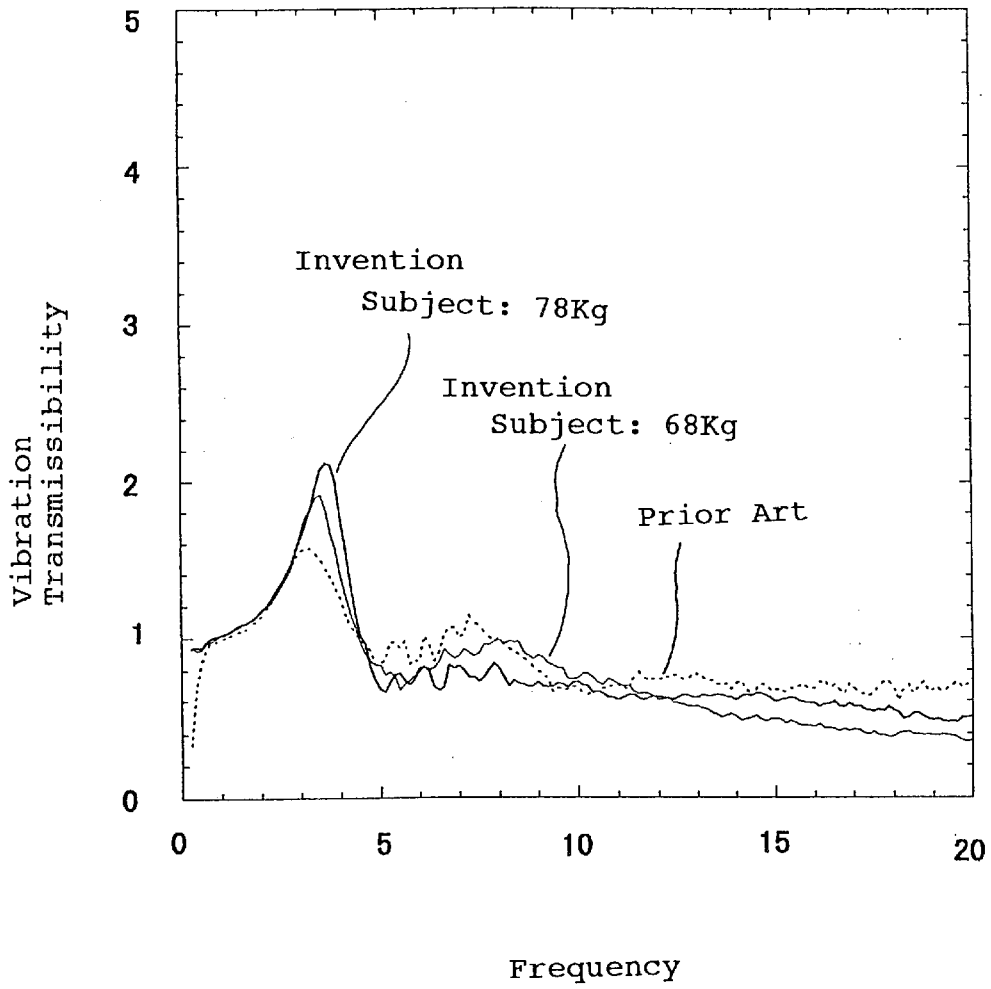
FIG. 25 is a graph showing dynamic characteristics when a random wave has been inputted to a seat having a net-shaped skin according to the present invention and to a conventional seat employing urethane.

FIG. 25 is a graph showing dynamic characteristics when a random wave has been inputted to a seat having a net-shaped skin according to the present invention and to a conventional seat employing urethane (thickness: 50 mm). There are little differences as a whole in the dynamic characteristics.

Figure 26:
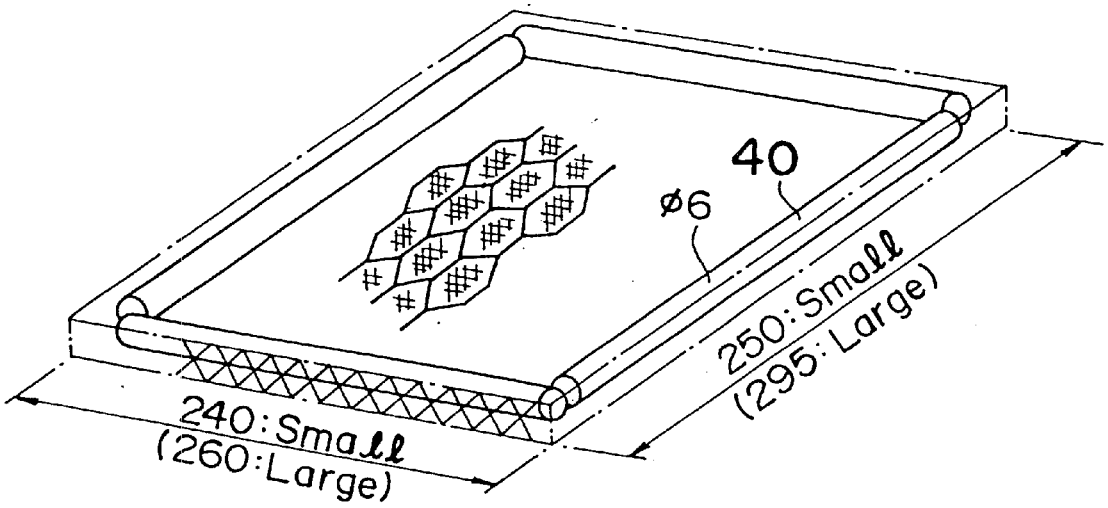
FIG. 26 depicts a net-shaped skin into which rigid members such as wires have been so inserted as to form a rectangle, (*a*) being a schematic perspective view thereof, and (*b*) being a schematic vertical sectional view thereof.
Figure 26:
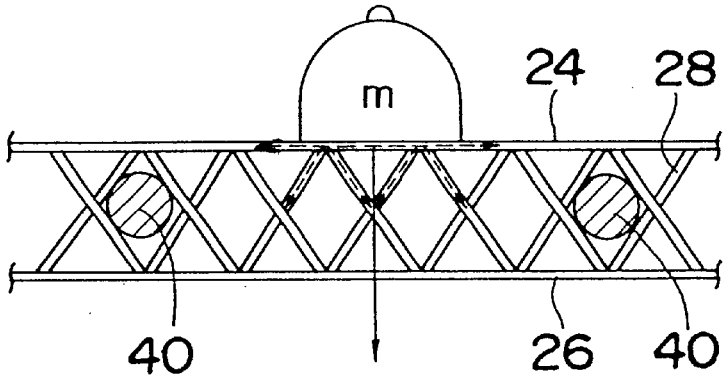

FIG. 26 depicts a net-shaped skin into which rigid members 40 such as wires have been so inserted as to form a rectangle to enhance the spring action. Removal of the rigid members 40 is prevented by welding the piles positioned on both sides of each rigid member 40.

As shown in FIG. 26(*b*), when a load m is applied to the net-shaped skin, axial components thereof act on X-piles (piles crossing each other), while horizontal components thereof act on the upper mesh layer 24. The horizontal components acting on the upper mesh layer 24 are affected by an increased surface rigidity of the net-shaped skin, resulting in a reduction in bottom-end shock.

Figure 27:
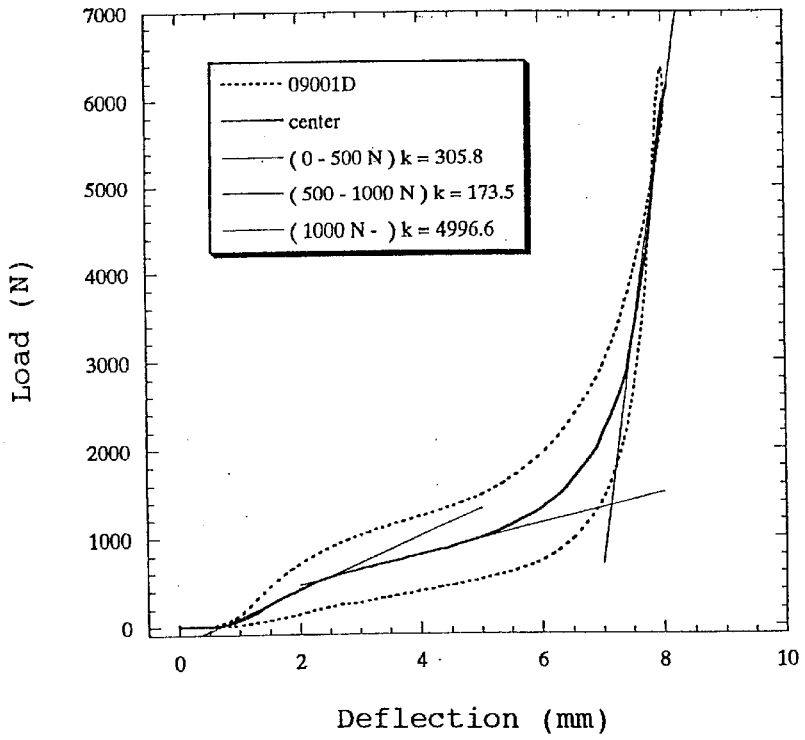
FIG. 27 is a graph showing static characteristics when a disc has been pressed as a net-shaped skin of item 09001D shown in Table 2.
Figure 28:
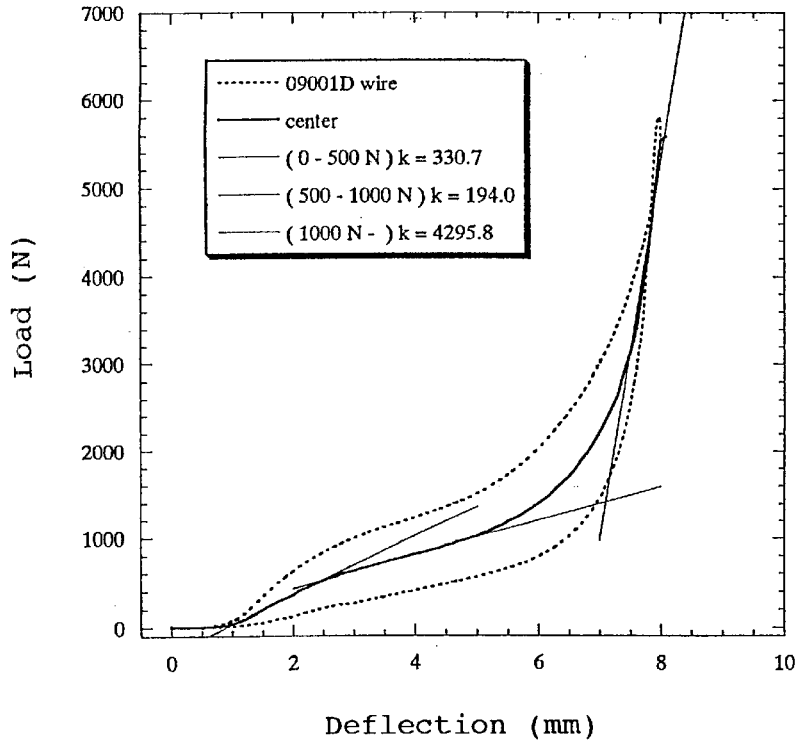
FIG. 28 is a graph showing static characteristics when wires have been inserted into the net-shaped skin of item 09001D at large intervals.
Figure 29:
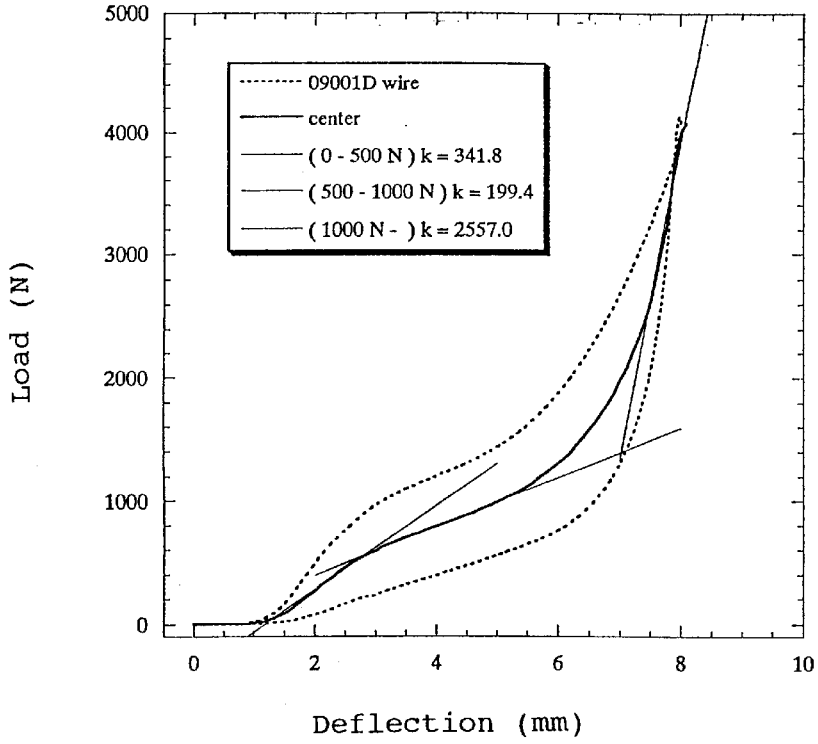
FIG. 29 is a graph showing static characteristics when wires have been inserted into the net-shaped skin of item 09001D at small intervals.

FIG. 27 is a graph showing static characteristics when a disc (ϕ200) has been pressed against a net-shaped skin of item 09001D shown in Table 2, while FIGS. 28 and 29 are graphs showing static characteristics when wires (ϕ6) have been inserted as the rigid members 40. The terms "Large" and "Small" mean the interval between the wires to be inserted, as shown in FIG. 26(*a*).

As can be seen from the graphs of FIGS. 27 to 29, the spring constant becomes large as a whole, and an increased surface rigidity increases the region resistant to load and reduces the bottom-end shock. If elastic members are used in place of the rigid members, the elasticity thereof can be utilized.

Figure 31:
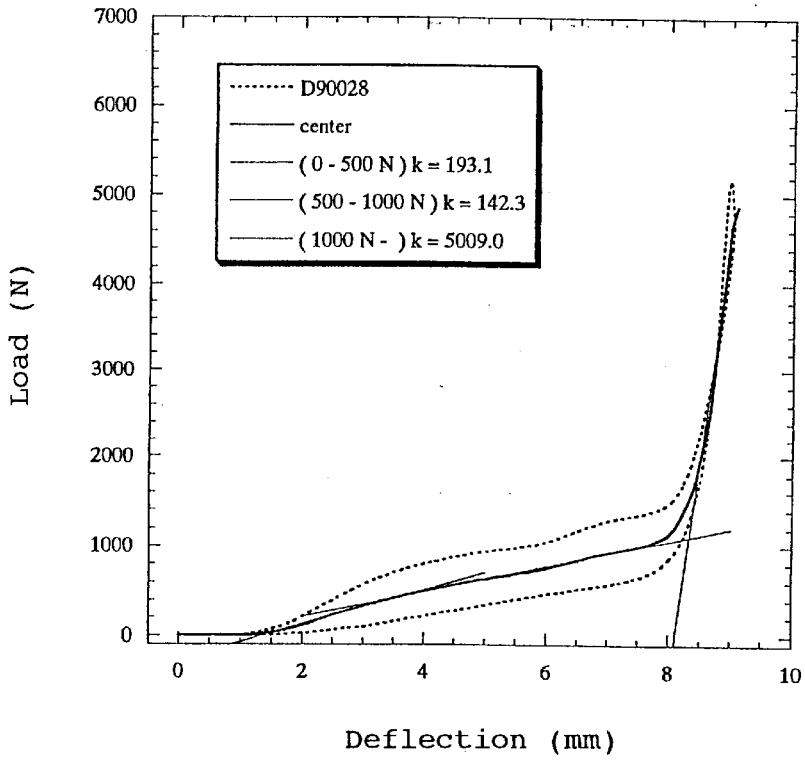
FIG. 31 is a graph showing static characteristics when a disc has been pressed against the cushioning member of FIG. 30.
Figure 30:
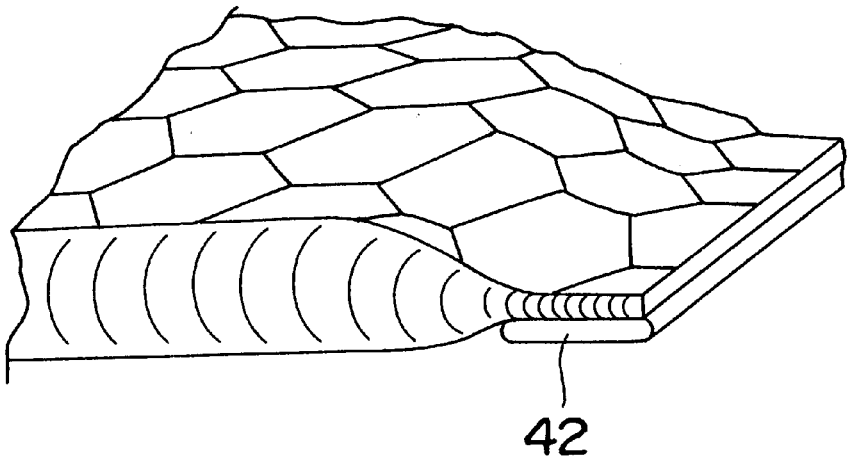
FIG. 30 depicts a cushioning member having a net-shaped skin to which resinous members have been vibration-welded at predetermined intervals, (*a*) being a schematic perspective view thereof, and (*b*) being a schematic top plan view thereof.
Figure 30:
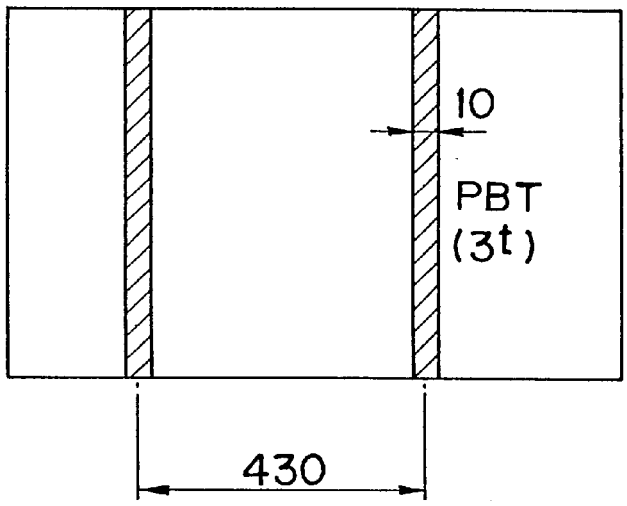

FIG. 30 depicts a cushioning member having a net-shaped skin to which resinous elastic members 42 such as PBT (polybutylene terephthalate) have been vibration-welded at two positions at a predetermined interval. FIG. 31 is a graph showing static characteristics when a disc (ϕ200) has been pressed against such a cushioning member.

As can be seen by comparing the graph of FIG. 31 with the graph of FIG. 20, the vibration welding of the resinous members increases the spring constant in the normal use region, enlarges the range of the normal use region, and reduces the bottom-end shock, as in the case in which the rigid members have been inserted in the form of a rectangle.

Figure 32:
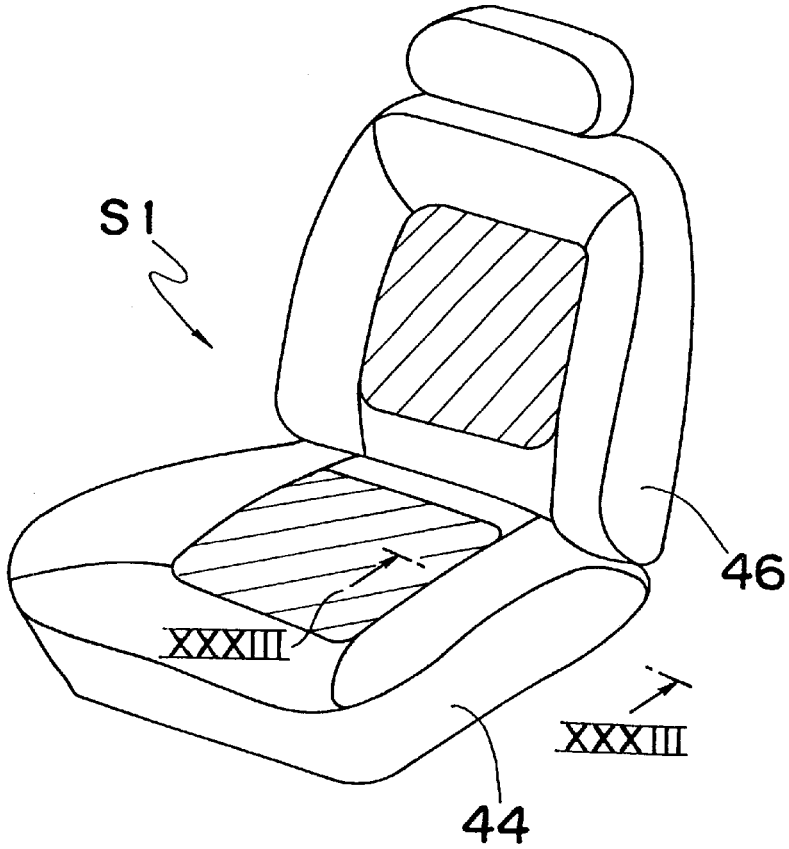
FIG. 32 is a perspective view of a seat employing the net-shaped skin according to the present invention.

FIG. 32 depicts a seat S1 in which the net-shaped skin according to the present invention is employed in a seat cushion 44 and in a seat back 46.

Figure 33:
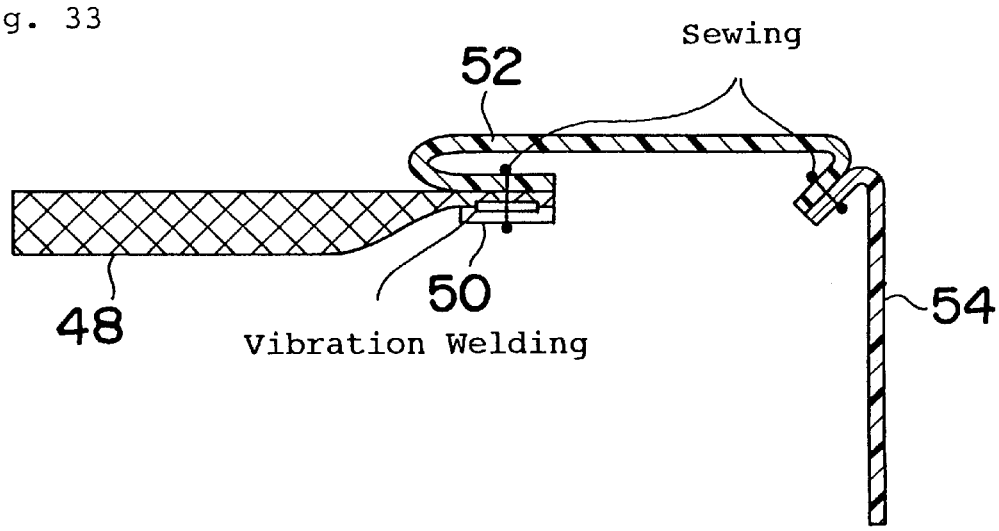
FIG. 33 is a cross-sectional view taken along line XXXIII—XXXIII in FIG. 32.

As shown in FIGS. 32 and 33, the net-shaped skin 48 is vibration-welded at its periphery to elastic members 50, and the periphery of the net-shaped skin 48 and the elastic members 50 are both joined to a patch or trim 52 by sewing. The trim 52 is further joined to a side skin 54 by sewing. Resins such as polypropylene or the like, wadding (hard pads), fabric bases, etc. are preferably used for the elastic members 50.

Figure 34:
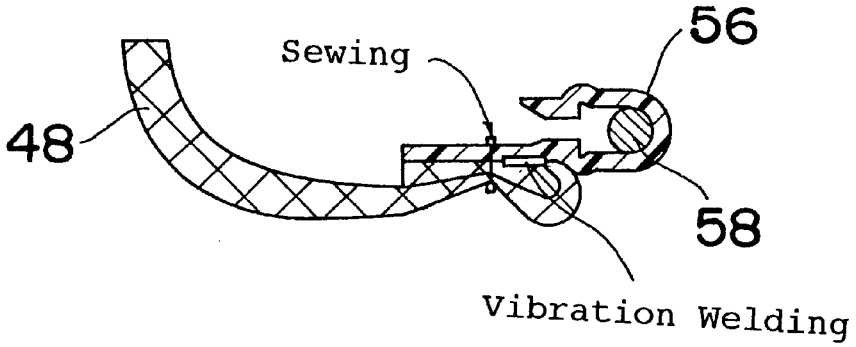
FIG. 34 is a cross-sectional view of the net-shaped skin and a seat frame joined together.

As shown in FIG. 34, after the net-shaped skin 48 has been properly positioned with respect to engageable members 56 such as clips by sewing (basting), the net-shaped skin 48 is joined at its periphery to the engageable members 56 by vibration welding for the fixing thereof to a portion 58 of a frame. Such construction enables the vibration-welded portions to support a large load applied to the net-shaped skin 48.

Figure 35:
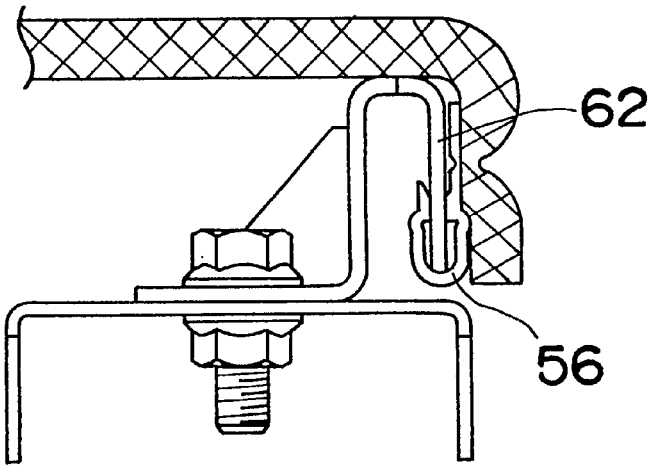
FIG. 35 is a cross-sectional view of the net-shaped skin and the seat frame joined together in a different fashion.
Figure 36:
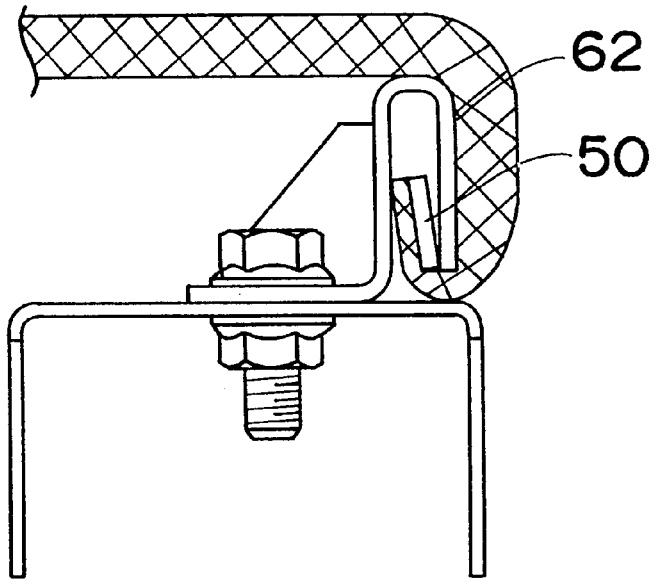
FIG. 36 is a cross-sectional view of the net-shaped skin and the seat frame joined together in another different fashion.

Furthermore, as shown in FIG. 35, the engageable members 56 may be engaged with a fitting 62 of the frame. Alternatively, before the fitting 62 is mounted on the frame, rigid members 50 vibration-welded to the periphery of the net-shaped skin may be first inserted into the fitting 62, which can be in turn secured to the frame, as shown in FIG. 36, thereby imparting a desired tension to the net-shaped skin without using any tensioning jig.

Figure 37:
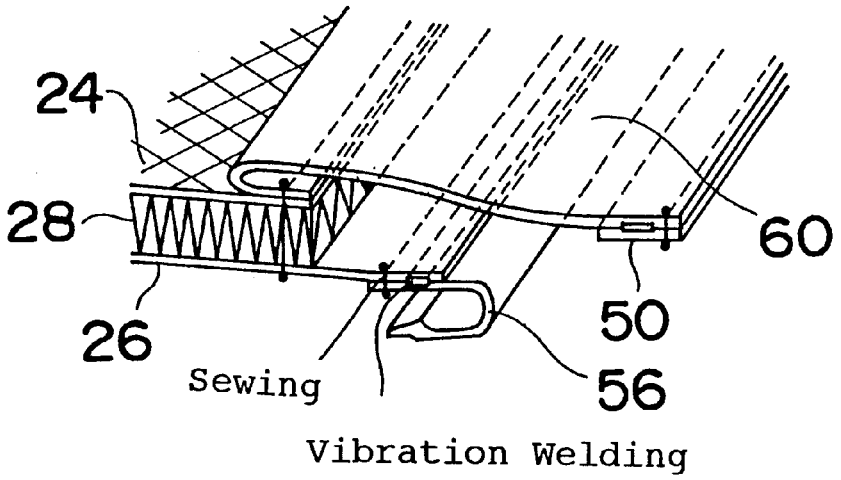
FIG. 37 is a fragmentary perspective view of a circumferential edge portion of the net-shaped skin when the pile layer has not been compressed.
Figure 38:
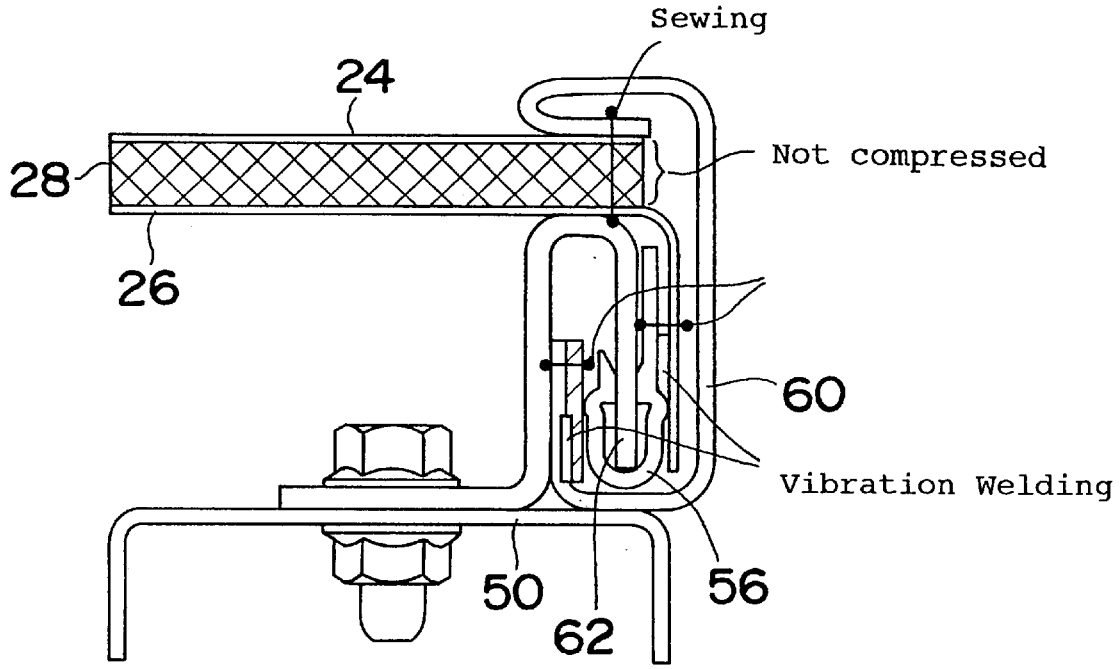
FIG. 38 is a cross-sectional view of the net-shaped skin of FIG. 37 and the seat frame joined together.

As shown in FIGS. 37 and 38, the engageable members 56 may be sewn and vibration-welded to only the lower mesh layer 26 of the net-shaped skin and, under the condition in which only sewn portions of the pile layer 28 that connects the upper and lower mesh layers 24, 26 are compressed, the periphery of the net-shaped skin may be joined to one end of a side skin 60 by sewing. In this case, the other end of the side skin 60 is sewn and vibration-welded to the rigid members 50, which are in turn engaged with the fitting 62 of the frame together with the engageable members 56.

Because this construction allows the pile layer 28 other than the sewn portions to be held under an uncompressed condition, compression of the piles by the tensioning of the net is avoided. Accordingly, when a user sits on the net-shaped skin, deflection of the piles disperses his load and, also, he does not receive any feeling of foreign substances from the frame and the like.

Figure 39:
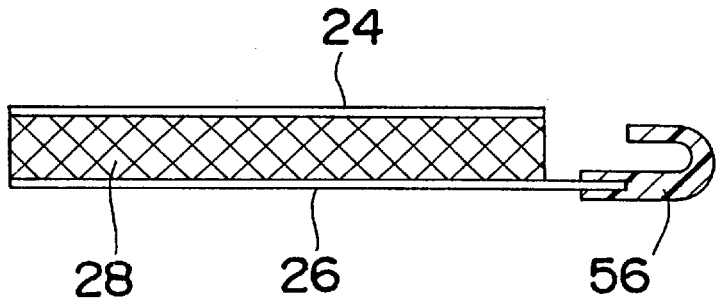
FIG. 39 is a cross-sectional view of a net-shaped skin having a hook member secured thereto by extrusion-molding or injection-molding.

As shown in FIG. 39, the lower mesh layer 26 and the engageable members 56 may be joined together by extrusion-molding or injection-molding the engageable members 56 to end portions of the lower mesh layer 26.

A seat in which a plurality of net-shaped skins according to the present invention are laminated is discussed hereinafter with reference to FIGS. 40 to 43.

Figure 40:
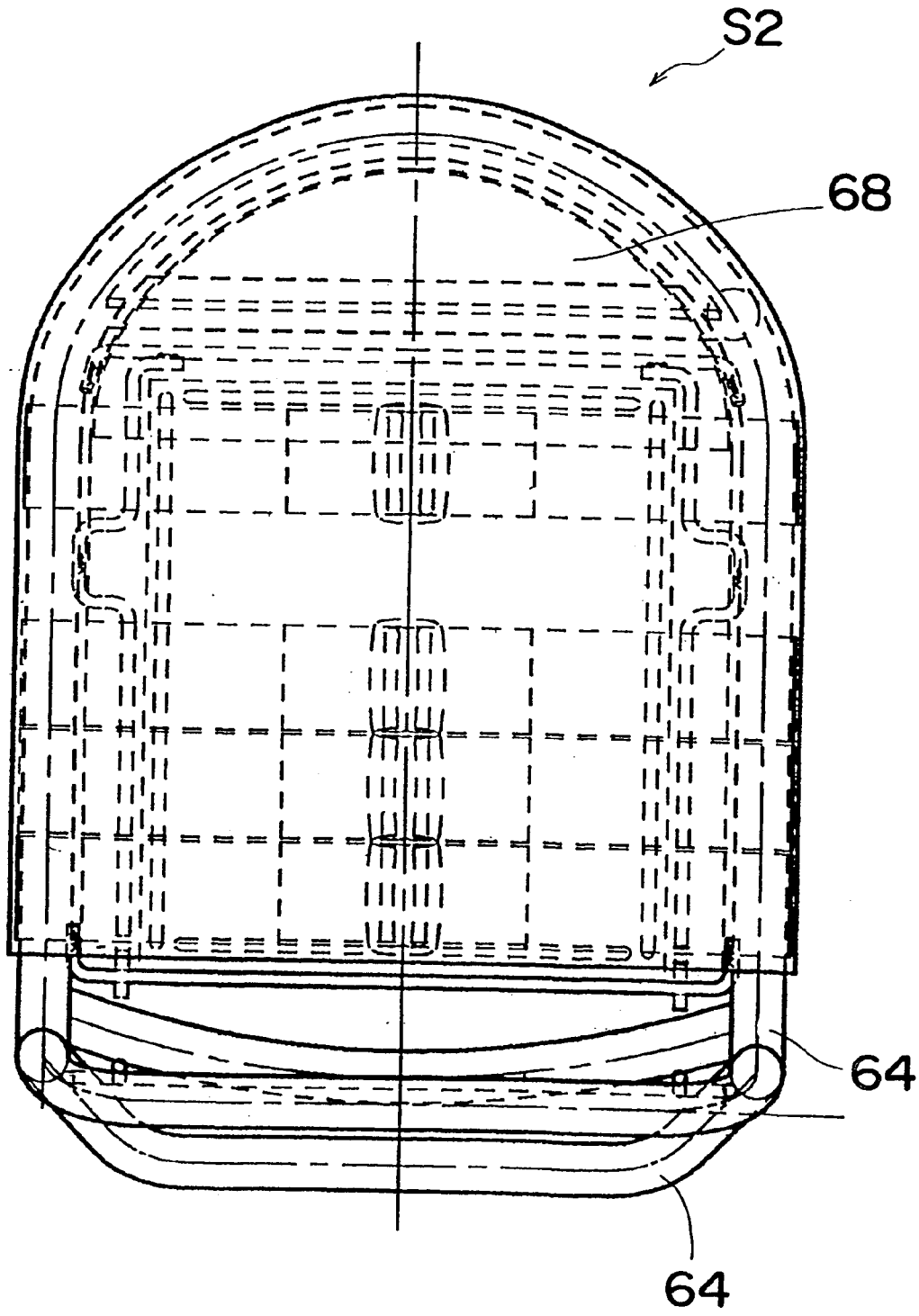
FIG. 40 is a front view of a seat having a seat back in which a plurality of net-shaped skins have been laminated.
Figure 41:
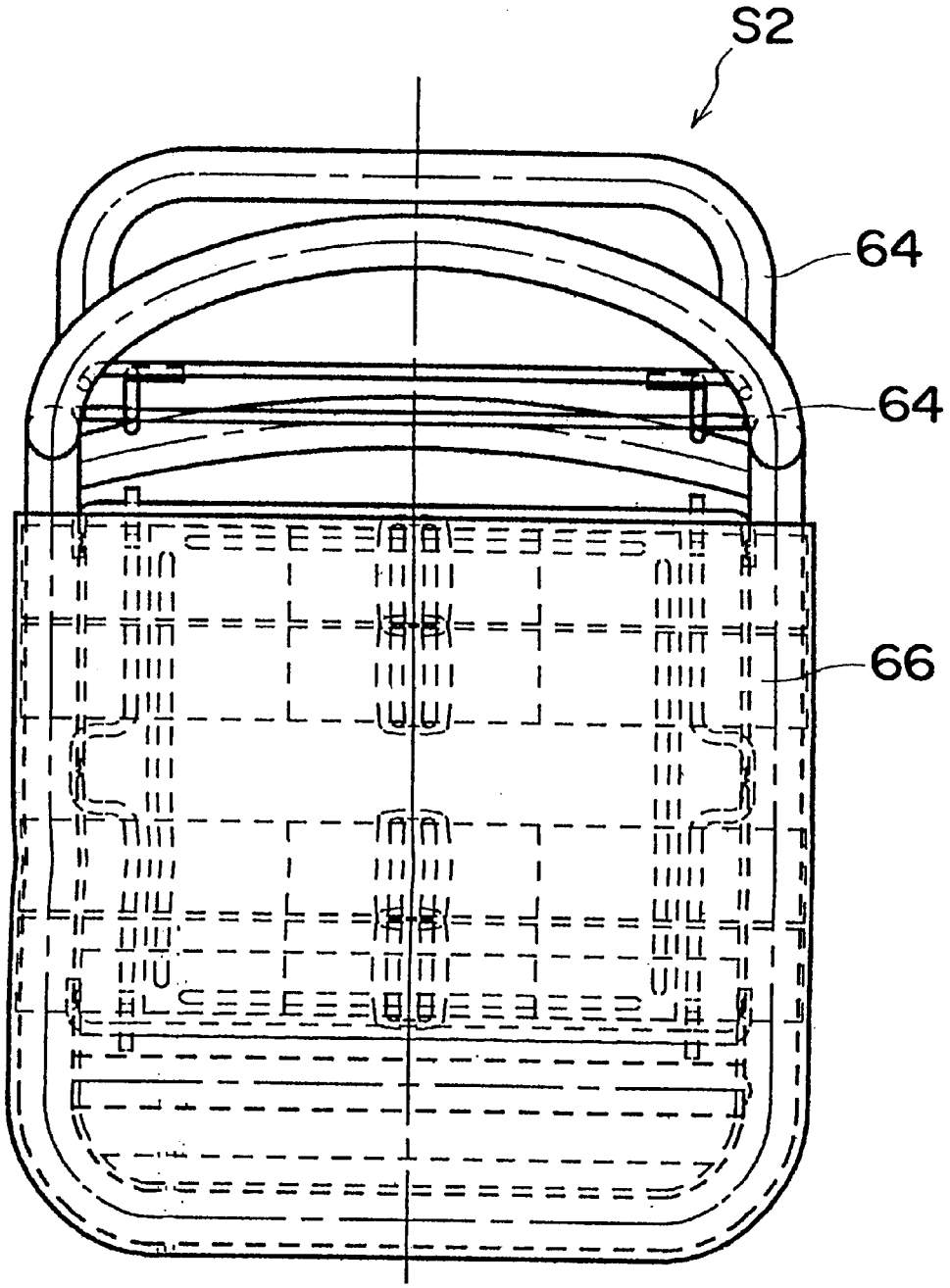
FIG. 41 is a top plan view of the seat of FIG. 40, particularly depicting a seat cushion in which net-shaped skins have been laminated.
Figure 42:
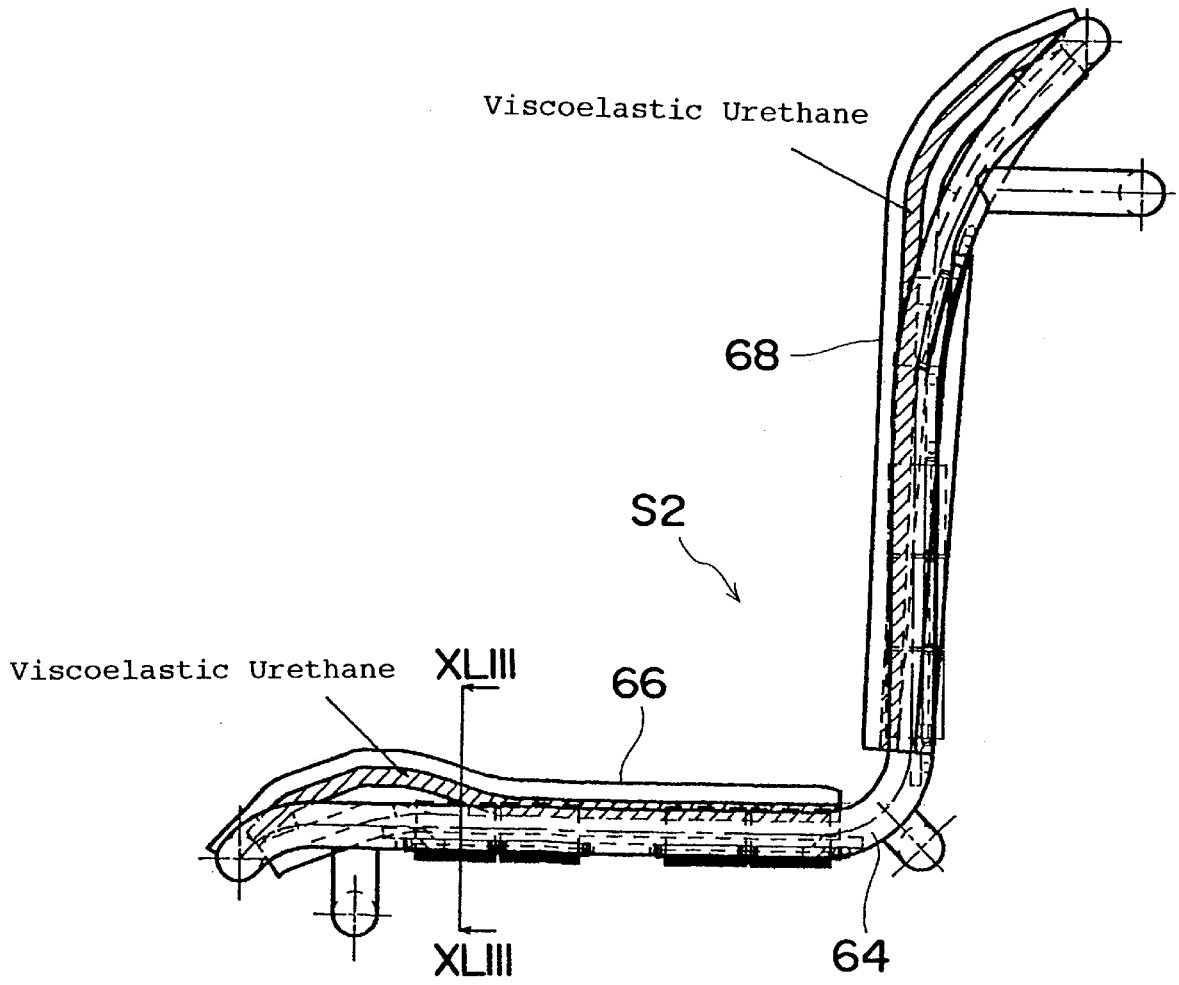
FIG. 42 is a side view of the seat of FIG. 40, partly in section, in which a viscoelastic urethane has been incorporated together with the net-shaped skins.

A seat S2 shown in FIGS. 40 to 42 includes a seat cushion 66 having a plurality of net-shaped skins laminated on pipe frames 64 and a seat back 68 similarly having a plurality of laminated net-shaped skins.

Figure 43:
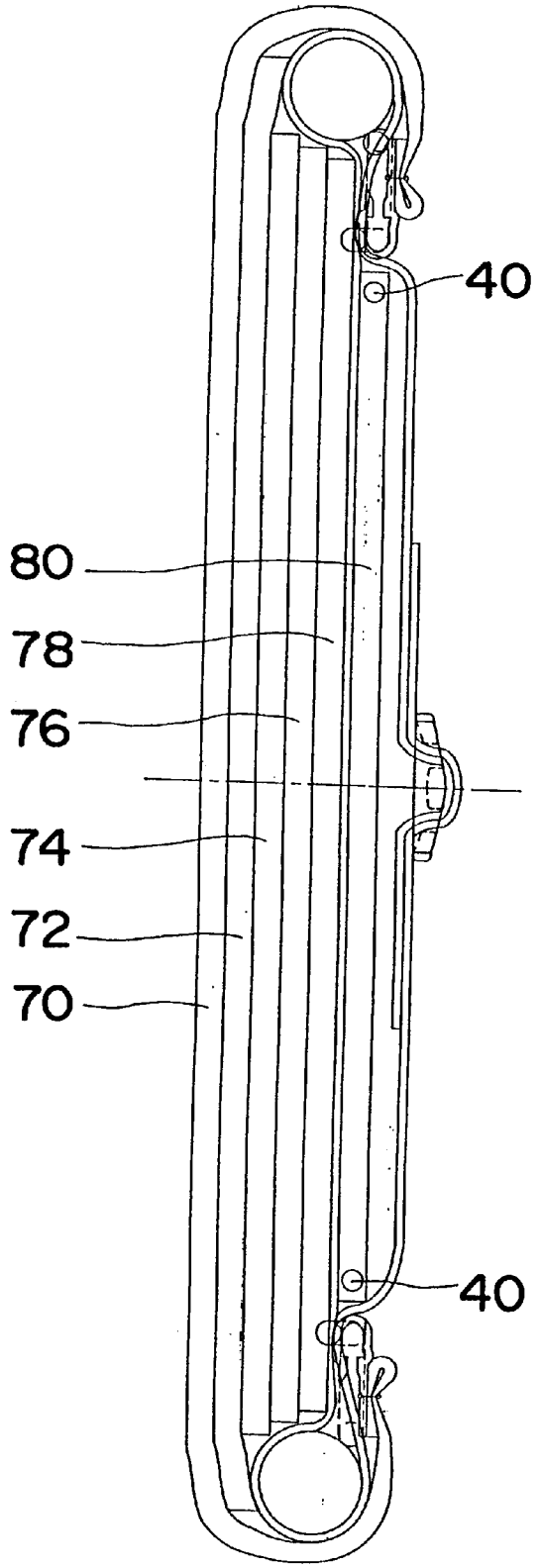
FIG. 43 is a cross-sectional view taken along line XLIII—XLIII in FIG. 42.

As shown in FIG. 43, each of the seat cushion 66 and the seat back 68 employs the plurality of net-shaped skins as the first layer 70, the second layer 72, the third layer 74, the fourth layer 76, the fifth layer 78, and the sixth layer 80, all of which are laminated one above the other in this order. The rigid members 40 as shown in FIG. 26 are inserted into the net-shaped skin 80 of the sixth layer. Any one of the second to sixth layers 72–80 may be an urethane layer.

In general, a thin urethane layer causes a bottom-end shock and, hence, a spring structure is normally imparted thereto or a highly elastic urethane is combined therewith. Although such a structure makes a cushion thick as a whole, a combination of the nets and urethane makes the cushion thinner than the conventional one and can cope with the bottom-end shock.

Figure 44:
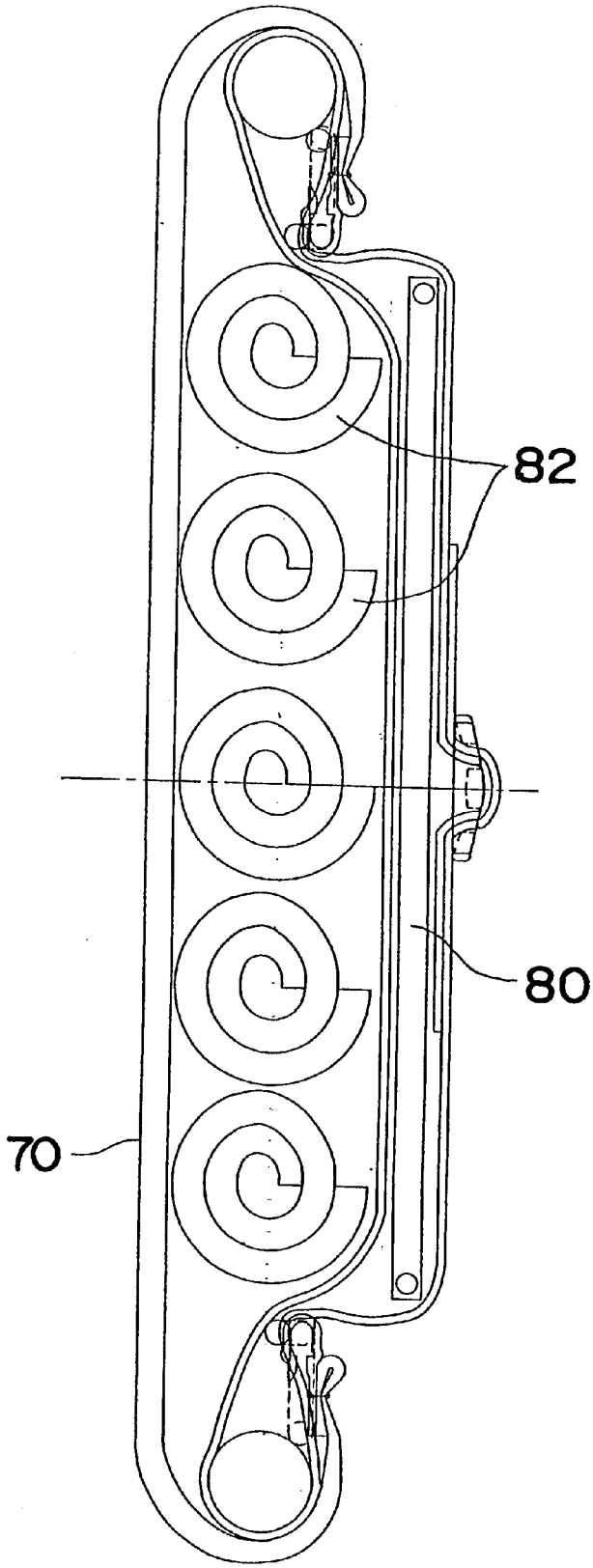
FIG. 44 is a cross-sectional view taken along line XLIII—XLIII in FIG. 42 when a plurality of rolled net-shaped skins have been disposed in a side-by-side fashion.

As shown in FIG. 44, a plurality of (five in FIG. 42) rolled net-shaped skins 82 may be arranged in a side-by-side fashion in place of the second to fifth layers 72–78 shown in FIG. 43.

The structure in which the plurality of net-shaped skins are laminated as shown in FIG. 43 or in which the rolled net-shaped skins are juxtaposed as shown in FIG. 44 can reduce the bottom-end shock that is received by a user on a seat and reduces a spring constant to thereby improve the vibration characteristics around the resonant points. It is possible to further improve the vibration characteristics around the resonant points by incorporating a different kind of material such as a damping material, viscoelastic urethane, highly elastic urethane, low-repulsive urethane or the like. It is also possible to make a seat comfortable or soft to sit on and have a relatively large stroke, thereby enhancing an initial feeling.

Body pressure distributions when a subject has sat on the seat having the net-shaped skin according to the present invention are explained hereinafter.

Figure 45:
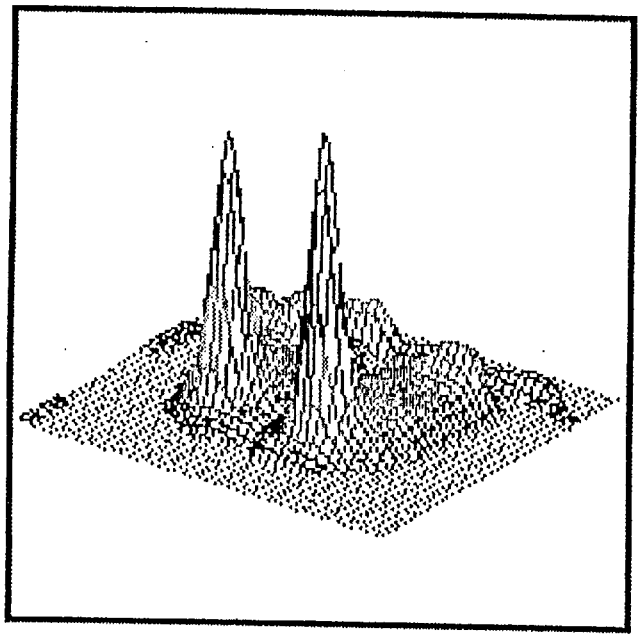
FIG. 45 a graph showing a body pressure distribution when a subject has sat on,net-shaped skin having a honeycomb-shaped layer in which no wires have been inserted.
Figure 46:
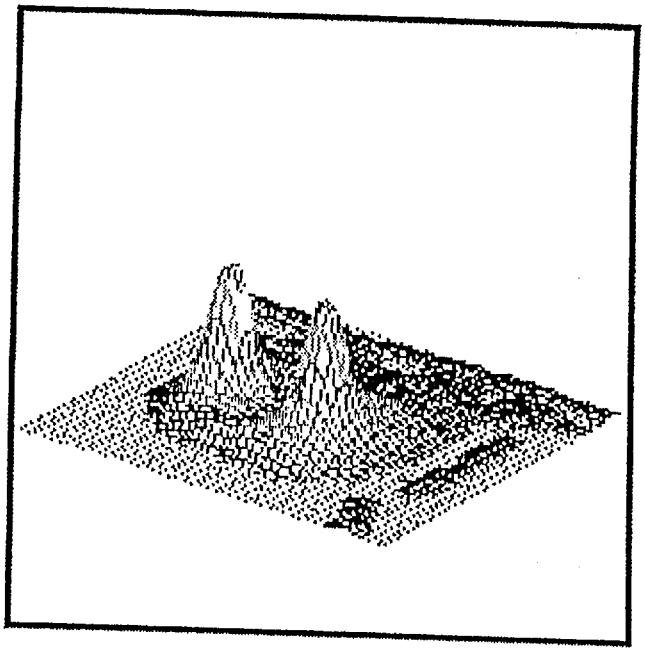
FIG. 46 is a graph showing a body pressure distribution when the subject has sat on a net-shaped skin having a honeycomb-shaped layer in which wires have been inserted.
Figure 47:
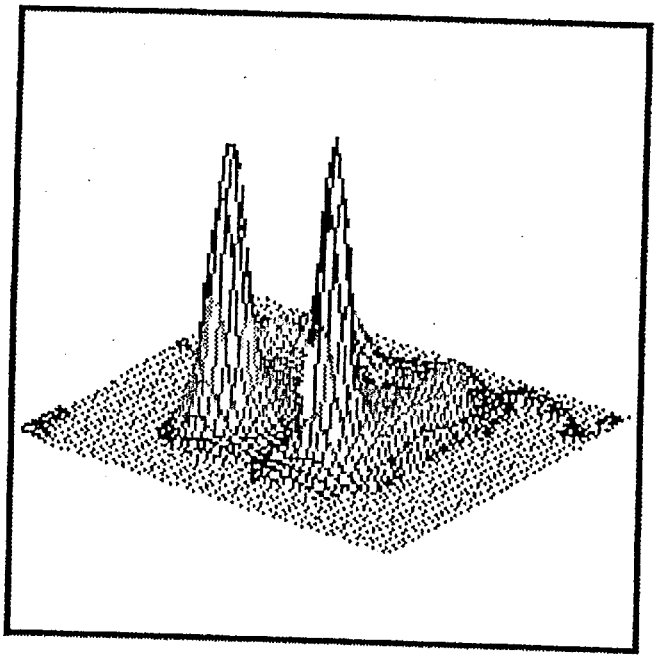
FIG. 47 is a graph showing a body pressure distribution when the subject has sat on a relatively small net-shaped skin having a honeycomb-shaped layer in which no wires have been inserted.
Figure 48:
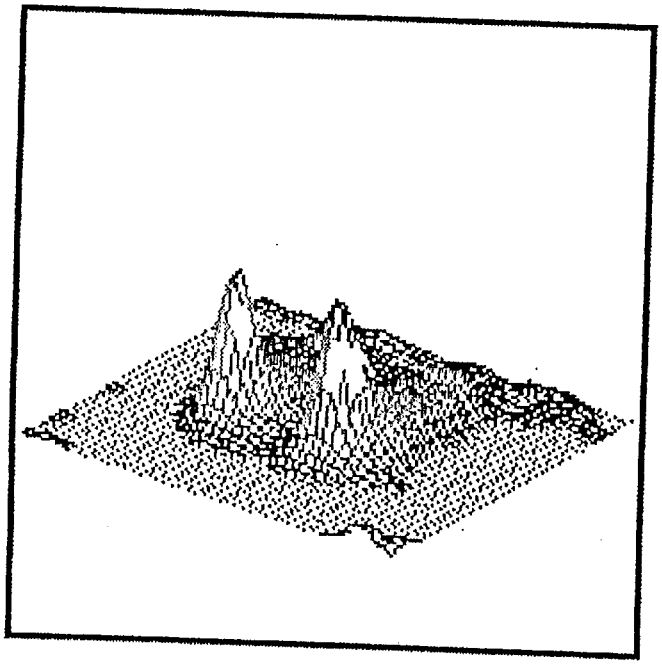
FIG. 48 is a graph showing a body pressure distribution when the subject has sat on a relatively small net-shaped skin having a honeycomb-shaped layer in which wires have been inserted.

FIGS. 45 and 46 show the body pressure distributions (subject weight 50 kg) when no wires have been inserted into the honeycomb-shaped upper and lower mesh layers 24, 26 and when wires have been inserted as shown in FIG. 26 (wire interval: large), respectively. FIGS. 47 and 48 similarly show the body pressure distributions (subject weight: 50 kg) when no wires have been inserted into the honeycomb-shaped upper and lower mesh layers 24, 26 and when wires have been inserted as shown in FIG. 26 (wire interval: small), respectively. As can be seen from the graphs of FIGS. 45 to 48, the surface rigidity of the cushioning member having the net-shaped skin is increased by inserting the wires, and the increased surface rigidity disperses the body pressure to thereby reduce the local pressure.

Figure 49:
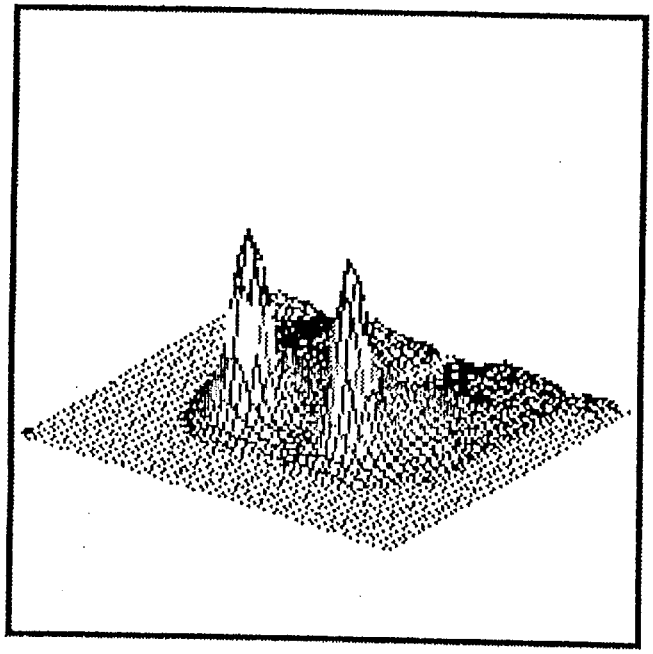
FIG. 49 is a graph showing a body pressure distribution when the subject has sat on a laminated structure of the net-shaped skin showing the static characteristics of FIG. 19 and the net-shaped skin showing the static characteristics of FIG. 20.
Figure 50:
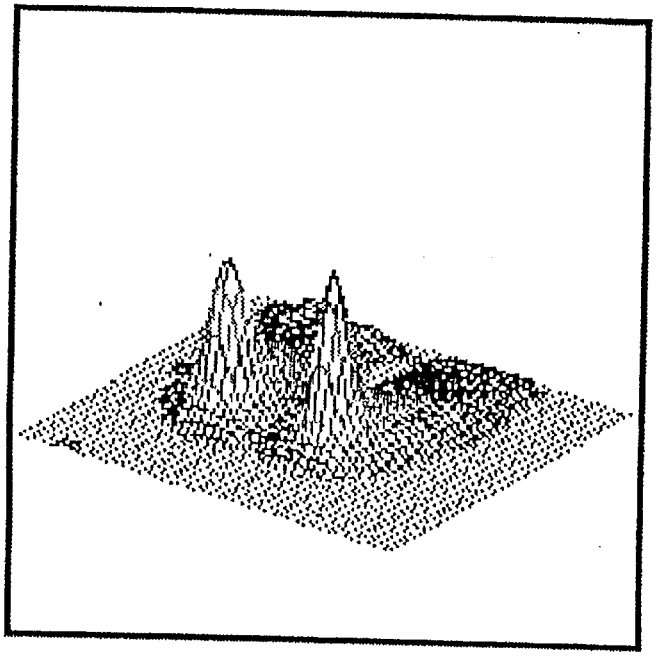
FIG. 50 is a graph showing a body pressure distribution when the subject has sat on a laminated structure of the net-shaped skin showing the static characteristics FIG. 19 and the net-shaped skin showing the static characteristics of FIG. 20, with resinous members being vibration-welded to a portion of the laminated structure.

FIGS. 49 and 50 show body pressure distributions (subject weight: 50 kg) when the subject has sat on a laminated structure of the net-shaped skin showing the static characteristics of FIG. 19 and the net-shaped skin showing the static characteristics of FIG. 20 with no resinous members vibration-welded thereto arid when the subject has sat on another laminated structure in which the resinous members have been vibration-welded thereto (only the lower layer), as shown in FIG. 30, respectively. As shown therein, the vibration welding of the resinous members makes each pile forming the pile layer resistant to deflection, which disperses the body pressure, thereby reducing the local pressure. Also, the elasticity of the cushioning member can be improved as a whole by making use of the elasticity of the resinous members, contributing to a reduction of the bottom-end shock.

Figure 51:
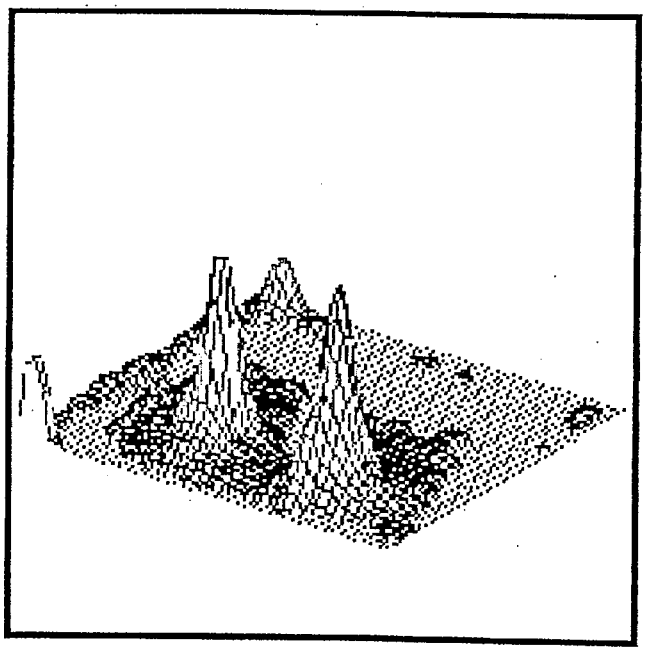
FIG. 51 is a graph showing a body pressure distribution when the subject has sat on a conventional seat employing urethane as a cushioning material.
Figure 52:
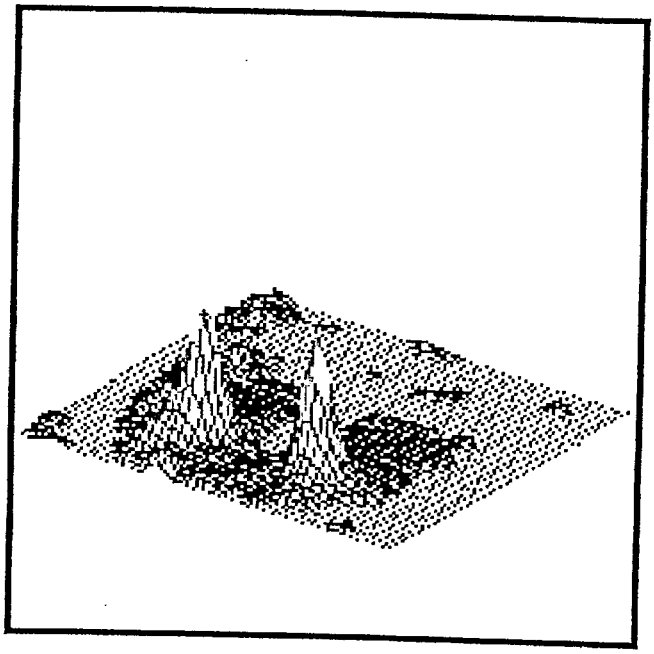
FIG. 52 is a graph showing a body pressure distribution when the subject has sat on a wheelchair employing the laminated structure shown in FIG. 43.

FIGS. 51 and 52 show body pressure distributions (subject weight: 50 kg) when the subject has sat on a conventional seat employing urethane as a cushioning material and when he has sat on a wheelchair employing the laminated structure shown in FIG. 43, respectively. The laminated structure of the cushioning member according to the present invention effectively disperses the body pressure and reduces the local pressure.

Figure 53:
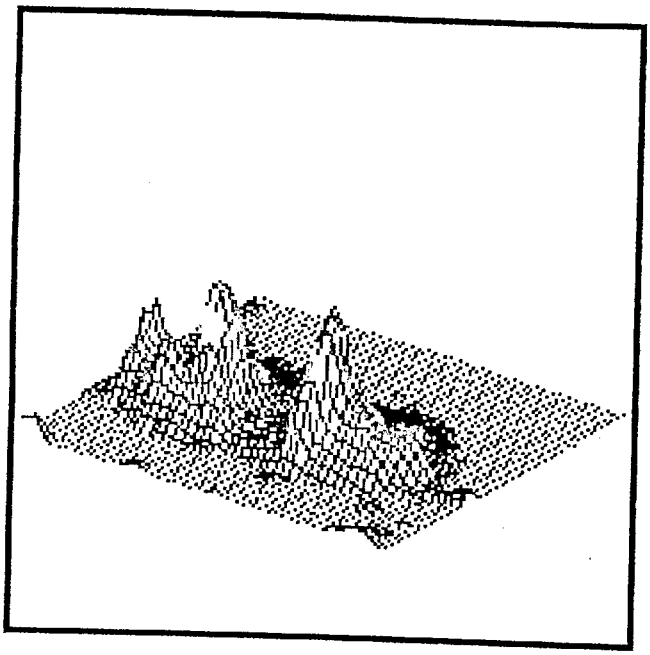
FIG. 53 is a graph showing a body pressure distribution when another subject having a different weight has sat on a conventional wheelchair.
Figure 54:
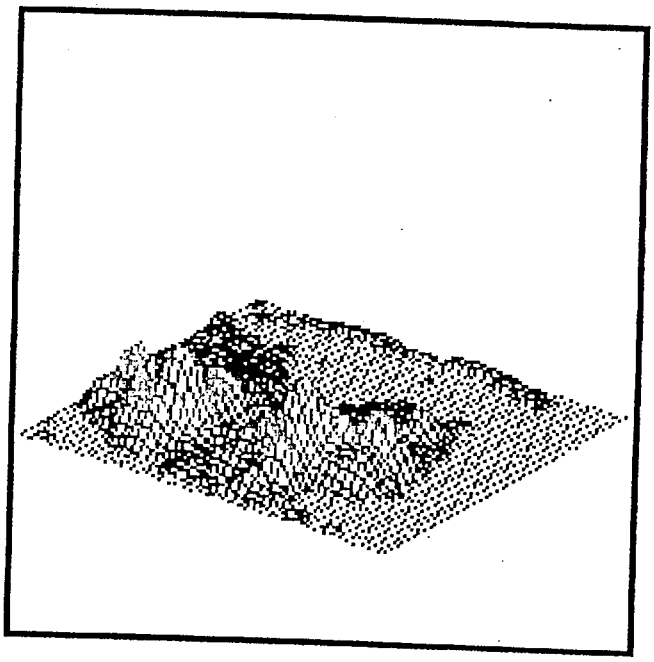
FIG. 54 is a graph showing a body pressure distribution when the subject of FIG. 53 has sat on the wheelchair employing the laminated structure shown in FIG. 43.

FIGS. 53 and 54 show body pressure distributions (subject weight: 74 kg) when another subject has sat on a conventional wheelchair and when he has sat on the wheelchair employing the laminated structure shown in FIG. 43, respectively. The laminated structure of the cushioning member according to the present invention effectively disperses the body pressure and reduces the local pressure irrespective of the subject weight.

Temperature and humidity characteristics are discussed hereinafter when a subject has sat on the conventional wheelchair and when he sat on the wheelchair having the laminated structure of the cushioning member according to the present invention.

Figure 55:
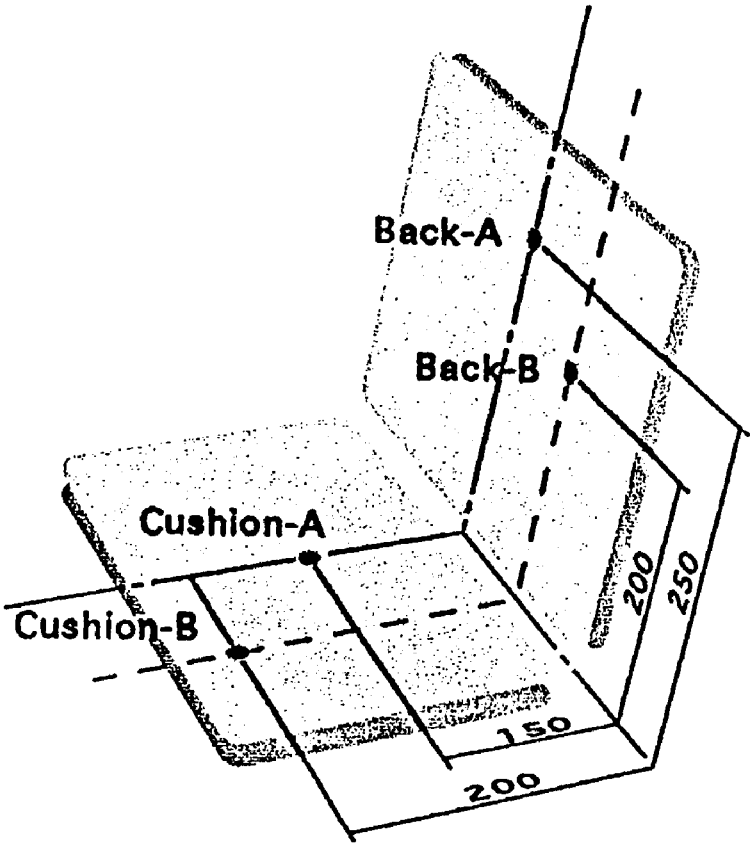
FIG. 55 is a schematic perspective view of a seat having several check points where temperature and humidity characteristics have been examined in a conventional wheelchair and a wheelchair according to the present invention.
Figure 56:
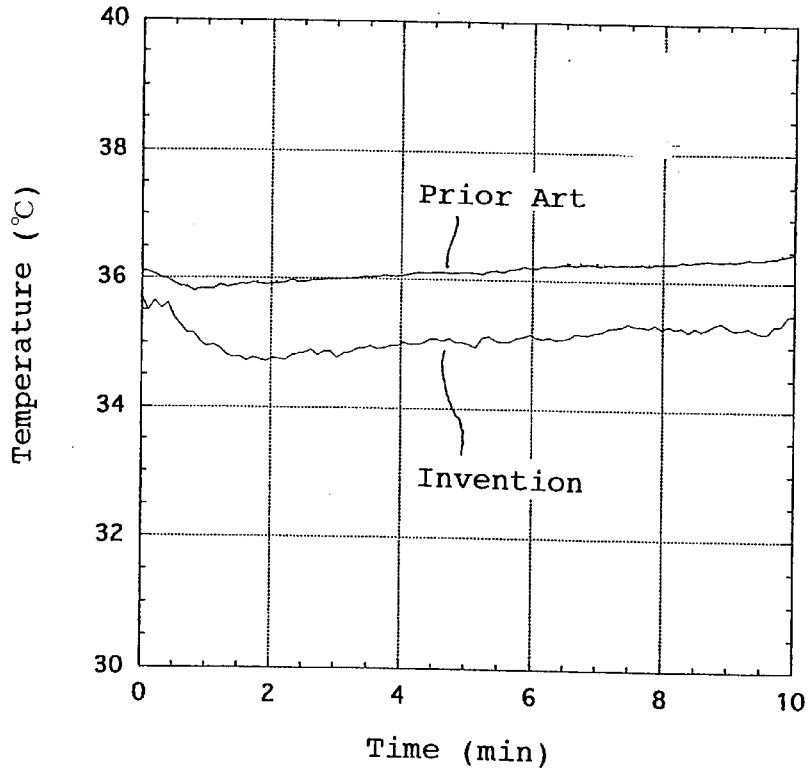
FIG. 56 is a graph showing temperature characteristics at point Cushion-A in FIG. 55 when the subject is a great sweater.
Figure 57:
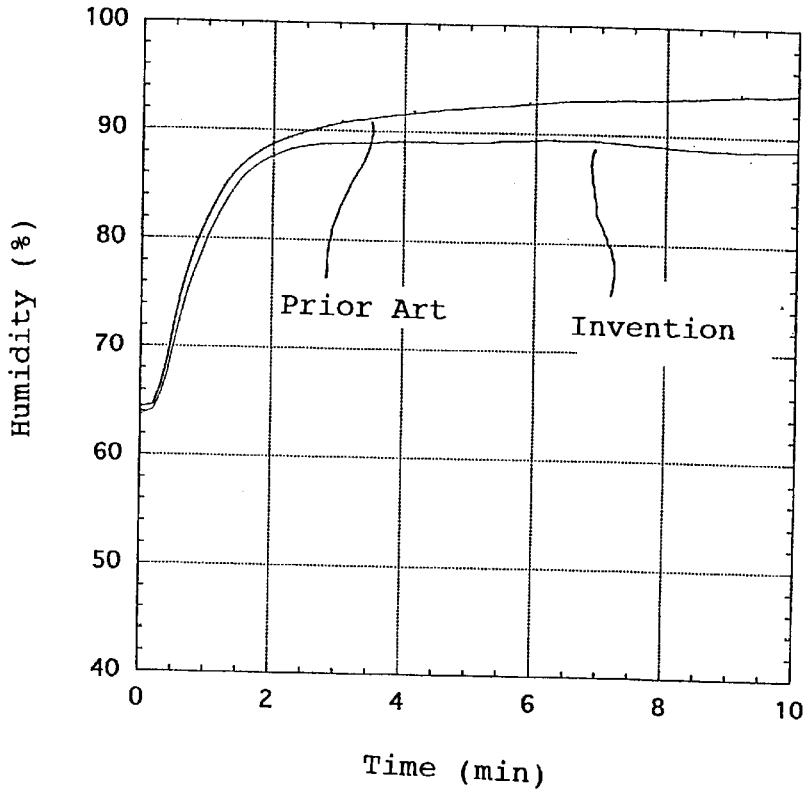
FIG. 57 is a graph showing humidity characteristics at point Cushion-A in FIG. 55 when the subject is a great sweater.
Figure 58:
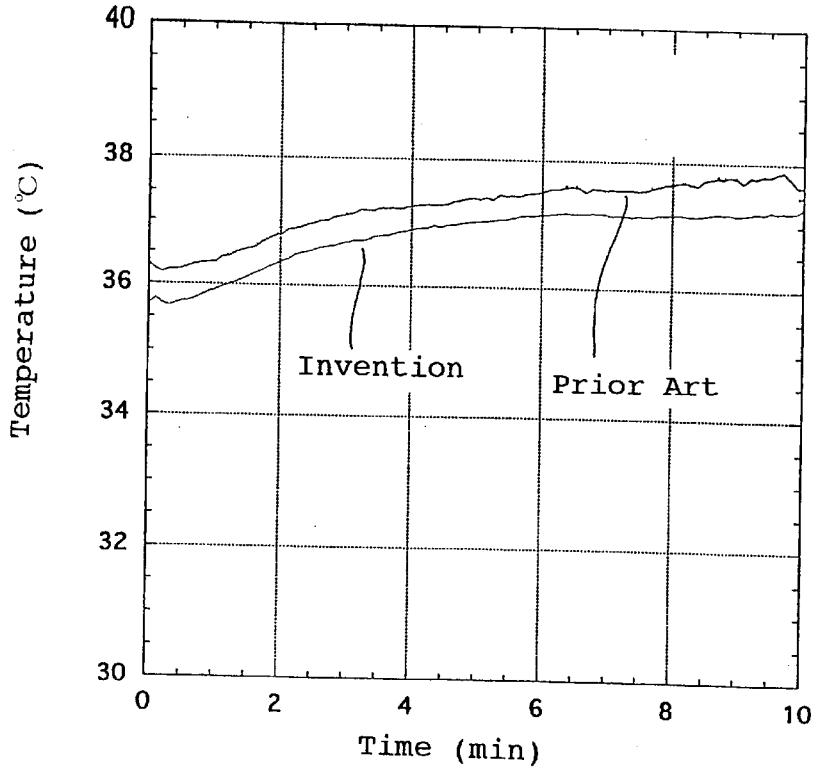
FIG. 58 is a graph showing temperature characteristics at point Back-A in FIG. 55 when the subject is an average man.
Figure 59:
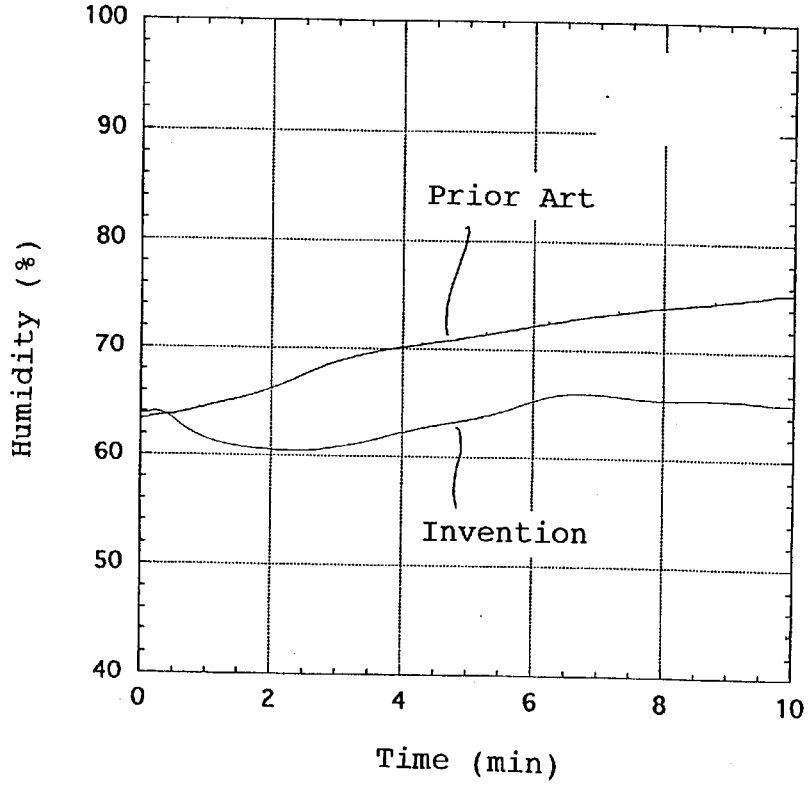
FIG. 59 is a graph showing humidity characteristics at point Back-A in FIG. 55 when the subject is an average man.

FIG. 55 shows several check points where temperature and humidity characteristics have been examined. FIGS. 56 and 57 show the characteristics at point Cushion-A when the subject is a great sweater, while FIGS. 58 and 59 show the characteristics at point Back-A when the subject is an average man (not a great sweater). The temperature and humidity of the atmosphere were 35° C. and 65%, respectively.

As can be seen from the graphs of FIGS. 56 and 57, because the wheelchair according to the present invention is excellent in air permeability and heat dissipation properties, the temperature characteristics and the humidity characteristics are both improved as compared with the conventional wheelchair.

A similar tendency has been recognized at point Cushion-B or point Back-B other than point Cushion-A and point Back-A, and the temperature and humidity characteristics are both improved at all points irrespective of subjects. In particular, when the subject is a great sweater, the body temperature is taken by vaporization of sweat and, hence, he feels very cool and comfortable.

With the above-described construction, the present invention provides the following effects.

Because a cushioning member according to the present invention includes a net-shaped skin tensioned over a frame, the air permeability is enhanced, and a seat or bed can be reduced in weight by incorporating the cushioning member thereinto. Also, because the net-shaped skin is of a three-layered structure including can upper mesh layer, a lower mesh layer, and a pile layer having a large number of piles that connect the upper and lower mesh layers, and because each of the piles is made of a single string, the cushioning member has desired cushioning characteristics by the action of the elasticity of each pile.

When the frame and the net-shaped skin are both made of a thermoplastic resin and joined together by vibration welding, they can be easily and strongly joined within a short period of time without lowering the physical properties of threads or strings of the net-shaped skin. Also, because both the frame and the net-shaped skin are made of a thermoplastic resin, it is possible to make all-weather seats that can be employed in motorcycles exposed to rainwater or the like.

Furthermore, when the net-shaped skin is made of a thermoplastic resin and joined to at least one holding member made of a thermoplastic resin by vibration welding, the holding member can be secured to a metal frame, which can be incorporated into an automotive seat that may receive an impact load. If the net-shaped skin is damaged, the skin and the holding member can be replaced together.

Also, if the holding member is secured to the frame after the net-shaped skin has been secured at the periphery thereof to the holding member by a string, an optional material can be used for the holding member or the frame.

If a resinous frame member is formed at the periphery of the net-shaped skin by insert molding and is secured to the above frame, a metal frame can be employed which can be incorporated into an automotive seat. In this case, if the net-shaped skin is damaged, the skin and the resinous frame member can be replaced together.

Furthermore, when the pile layer has a cross texture as viewed in a specific direction, there is no directional property of inclination of piles, enhancing the rigidity and allowing the sewing.

Because the net-shaped skin has non-linear static load-deflection characteristics and also has the smallest spring constant in a normal use region including a balanced point, the transient response characteristics and the frequency response characteristics can be both improved. That is, the acceleration and deflection are attenuated quickly with respect to input changes and, hence, the period of time to the steady state can be shortened.

If rigid members or elastic members are disposed at predetermined intervals, the surface rigidity or the entire rigidity of the net-shaped skin can be increased, thereby reducing a bottom-end shock.

When engageable members attached at the periphery of the net-shaped skin by sewing and vibration welding are engaged with a portion of a seat, not only can the positioning of the engageable members relative to the net-shaped skin be carried out by sewing, but a load applied to the seat can also be received by vibration-welded portions.

Furthermore, when the engageable members are attached at the periphery of the lower mesh layer and engaged with a portion of a seat under the condition in which the pile layer other than the sewn portions is not compressed, no feeling of foreign substances is sensed at the periphery of the net-shaped skin. In this case, the engageable members can be readily attached at the periphery of the lower mesh layer by extrusion-molding or injection-molding.

In addition, when a plurality of net-shaped skins laminated one above another or a plurality of rolled net-shaped skins arranged in a side-by-side fashion are incorporated into a seat the seat can be made thin, reduces a bottom-end shock, and improves vibration characteristics around the balanced point, as compared with conventional structures.

What is claimed is:

1. A cushioning member having a net-shaped skin, which comprises a frame and a net-shaped skin tensioned over said frame, said net-shaped skin comprising an upper mesh layer, a lower mesh layer, and a pile layer having a large number of piles that connect said upper and lower mesh layers, each of said piles being made of a single string.

2. The cushioning member having the net-shaped skin according to claim 1, wherein said frame and said net-shaped skin are each made of a thermoplastic resin, and both of them are joined together by vibration welding.

3. The cushioning member having the net-shaped skin according to claim 1, wherein said frame is made of a metal, while said net-shaped skin is made of a thermoplastic resin, and wherein after said net-shaped skin has been joined to at least one holding member made of a thermoplastic resin, said holding member is secured to said frame.

4. The cushioning member having the net-shaped skin according to claim 1, wherein after said net-shaped skin has been secured at a periphery thereof to a holding member by a string, said holding member is secured to said frame.

5. The cushioning member having the net-shaped skin according to claim 1, wherein a resinous frame is formed at a periphery of said net-shaped skin by insert molding, and said resinous frame is secured to said frame.

6. In a seat having a seat cushion and a seat back, at least one of said seat cushion and seat back comprises a frame and a net-shaped skin tensioned over said frame, said net-shaped skin comprising an upper mesh layer, a lower mesh layer, and a pile layer having a large number of piles that connect said upper and lower mesh layers, each of said piles being made of a single string.

7. The seat having the net-shaped skin according to claim 6, wherein said frame and said net-shaped skin are each made of a thermoplastic resin, and both of them are joined together by vibration welding.

8. The seat having the net-shaped skin according to claim 6, wherein said frame is made of a metal, while said net-shaped skin is made of a thermoplastic resin, and wherein after said net-shaped skin has been joined to at least one holding member made of a thermoplastic resin, said holding member is secured to said frame.

9. The seat having the net-shaped skin according to claim 6, wherein after said net-shaped skin has been secured at a periphery thereof to a holding member by a string, said holding member is secured to said frame.

10. The seat having the net-shaped skin according to claim 6, wherein a resinous frame is formed at a periphery of said net-shaped skin by insert molding, and said resinous frame is secured to said frame.

11. In a seat having a seat cushion, a seat back and a head rest, at least one of said seat cushion, seat back and said head rest comprises a frame and a net-shaped skin tensioned over said frame, said net-shaped skin comprising an upper mesh layer, a lower mesh layer, and a pile layer having a large number of piles that connect said upper and lower mesh layers, each of said piles being made of a single string.

12. A cushioning member having a net-shaped skin, wherein said net-shaped skin is of a three-layered structure comprising an upper mesh layer, a lower mesh layer, and a pile layer having a large number of piles that connect said upper and lower mesh layers, each of said piles being made of a single string, said pile layer presenting a cross texture as viewed in a predetermined direction.

13. The cushioning member having the net-shaped skin according to claim 12, wherein said net-shaped skin has non-linear static load-deflection characteristics and also has at least three spring constants in a normal use region, a region smaller in load than said normal use region, and a region greater in load than said normal use region, and wherein the spring constant in said normal use region is set to a smallest one.

14. The cushioning member having the net-shaped skin according to claim 12, further comprising rigid members or elastic members disposed at predetermined intervals in at least one direction, thereby increasing a surface rigidity or elasticity of said upper mesh layer.

15. The cushioning member having the net-shaped skin according to claim 12, further comprising engageable members mounted on a periphery of said net-shaped skin by vibration welding, wherein said engageable members are mounted on a portion of a seat.

16. The cushioning member having the net-shaped skin according to claim 12, further comprising engageable members mounted on a periphery of said lower mesh layer, wherein said engageable members are mounted on a portion of a seat with said pile layer being not compressed.

17. The cushioning member having the net-shaped skin according to claim 16, wherein said engageable members are mounted on the periphery of said lower mesh layer by extrusion molding.

18. A seat having a plurality of net-shaped skins laminated one upon another, wherein each of said net-shaped skins is of a three-layered structure comprising an upper mesh layer, a lower mesh layer, and a pile layer having a large number of piles that connect said upper and lower mesh layers, each of said piles being made of a single string, said pile layer presenting a cross texture as viewed in a predetermined direction.

19. A seat having a plurality of rolled net-shaped skins arranged in a side-by-side fashion, wherein each of said net-shaped skins is of a three-layered structure comprising an upper mesh layer, a lower mesh layer, and a pile layer having a large number of piles that connect said upper and lower mesh layers, each of said piles being made of a single string, said pile layer presenting a cross texture as viewed in a predetermined direction.

* * * * *